US005575820A

United States Patent [19]

Fritzsche

[11] Patent Number: 5,575,820

[45] Date of Patent: Nov. 19, 1996

[54] PROCESS FOR THE FIXATION OF DYES CONTAINING AT LEAST ONE POLYMERISABLE DOUBLE BOND BY MEANS OF IONISING RADIATION

[75] Inventor: Katharina Fritzsche, Weil am Rhein, Germany

[73] Assignee: Ciba-Geigy Corporation, Tarrytown, N.Y.

[21] Appl. No.: 343,588

[22] PCT Filed: May 21, 1993

[86] PCT No.: PCT/EP93/01265

§ 371 Date: Dec. 2, 1994

§ 102(e) Date: Dec. 2, 1994

[87] PCT Pub. No.: WO93/24700

PCT Pub. Date: Dec. 9, 1993

[30] Foreign Application Priority Data

| | | | |
|---|---|---|---|
| Jun. 4, 1992 | [CH] | Switzerland | 1804/92 |
| Jun. 4, 1992 | [CH] | Switzerland | 1805/92 |
| Dec. 1, 1992 | [CH] | Switzerland | 3685/92 |

[51] Int. Cl.[6] ..... D06P 5/20; D06P 1/52; D06P 3/66

[52] U.S. Cl. ..... 8/444; 8/549; 8/552; 8/554; 8/558; 8/606; 8/586; 8/587; 8/582; 8/594; 8/662; 8/532

[58] Field of Search ..... 8/444, 549, 552–558, 8/606, 586, 587, 582, 594, 662, 532, 925

[56] References Cited

U.S. PATENT DOCUMENTS

| | | | |
|---|---|---|---|
| 4,588,411 | 5/1986 | Scheibli et al. | 8/528 |
| 5,147,411 | 9/1992 | Töpfl | 8/606 |
| 5,238,465 | 8/1993 | Fritzache | 8/444 |
| 5,389,108 | 2/1995 | Fritzsche | 8/444 |

FOREIGN PATENT DOCUMENTS

| | | |
|---|---|---|
| 0144093 | 6/1985 | European Pat. Off. . |
| 0168749 | 1/1986 | European Pat. Off. . |
| 0466648 | 1/1992 | European Pat. Off. . |
| 56-096976A | 8/1981 | Japan . |
| 4095053A | 3/1992 | Japan . |
| 57167455A | 10/1992 | Japan . |
| 388254A | 6/1965 | Switzerland . |
| 899798 | 6/1962 | United Kingdom . |

OTHER PUBLICATIONS

McGraw–Hill's Dictionary of Scientific and Technical Terms, pp. 1580 and 1640, Sybil P. Parker, Editor and Chief 1984.

C.A. 98:108842p, abstract of JP 57–167455; Oct. 1992.

C.A. 117:70513c; abstract of JP 4095053 Mar. 1992.

C.A. 95:205340u abstract of JP 56–96976; Aug. 1981.

C.A. 105:24767t (Jan. 1986); ab of DE 3,426,197.

*Primary Examiner*—Margaret Einsmann

*Attorney, Agent, or Firm*—Kevin T. Mansfield

[57] ABSTRACT

A process for the dyeing and printing of organic material, in particular fibre material, which comprises applying dyes containing at least one polymerisable double bond together with at lease one colourless cationic compound containing at least one polymerisable double bond and, if desired, one or more colourless nonionic compounds containing at least one polymerisable double bond and, if desired, further auxiliaries to the organic material, in particular fibre material, and then fixing them by means of ionizing radiation.

35 Claims, No Drawings

PROCESS FOR THE FIXATION OF DYES CONTAINING AT LEAST ONE POLYMERISABLE DOUBLE BOND BY MEANS OF IONISING RADIATION

The invention relates to a process for the dyeing or printing of organic material, in particular fibre material, which comprises applying dyes containing at least one polymerisable double bond together with at least one colourless cationic compound containing at least one polymerisable double bond and, if desired, one or more colourless nonionic compounds containing at least one polymerisable double bond and, if desired, further auxiliaries to the organic material, in particular fibre material, and then fixing them by means of ionising radiation.

The fixation of dyes containing-activated unsaturated groups by exposure of organic material, even fibre material, to ionising radiation is known. Compared with the conventional methods for the fixation of dyes, in particular of reactive dyes, fixation produced by radiation is distinguished by the fact that, for example, fixing baths and fixing agents can be completely avoided. The simultaneous application and fixation of dye and textile finishing agents, for example for improving antistatic properties., reducing the soilability and the crease resistance, was regarded as a further advantage. Furthermore, to improve crosslinking of the dye and the fibre, polymerisable compounds were added to the dye liquor, and the dry dyed material was irradiated in order to fix the dye. An increase in the fixation yield could not be observed.

The practice of dyeing, in particular with reactive dyes but also with disperse dyes, has recently led to increased demands on the quality of the dyeing and the economy of the dyeing process. Fixation of reactive dyes by means of ionising radiation alone has hitherto not yet been carried out in practice due to the low degrees of fixation. Consequently, the object of the present invention is to provide an improved process for fixation which in addition exhibits the advantages of fixation produced by radiation.

It has now been found that this object can be achieved by means of the inventive process described below.

Accordingly, the present invention relates to a process for the dyeing or printing of organic material, in particular fibre material, which comprises applying dyes containing at least one polymerisable double bond together with at least one colourless cationic compound containing at least one polymerisable double bond and, if desired, one or more colourless nonionic compounds containing at least one polymerisable double bond and, if desired, further auxiliaries to the organic material, in particular fibre material, and then fixing them by means of ionising radiation. The process according to the invention is distinguished by the fact that dye and colourless cationic compound can be applied together, so that only a single dye bath or dyeing liquor is necessary and a substantially higher degree of fixation is achieved than in the known processes which do not use a colourless cationic polymerisable compound. A further advantage is that the process can be operated at such a low radiation dosage that less dye is destroyed, resulting in high brilliance of the dyeing.

The process according to the invention considerably reduces the use of auxiliaries and apparatuses, since, according to the fixation procedure of the invention, no fixing alkali has to be washed off, rather only drying and maybe a brief rinsing of the dyed or printed fibre material are necessary.

The process of fixation consists in irradiating a fibre material to be dyed, for example a textile fibre material, after the treatment with a dye containing at least one polymerisable double bond and/or at least one polymerisable ring system and in the presence of at least one colourless cationic compound containing at least one polymerisable double bond and, if desired, one or more colourless nonionic compounds containing at least one polymerisable double bond and, if desired, further auxiliaries while wet, moist or dry with ionising radiation for a short period. The treatment of the fibre material to be dyed with a dye according to the definition can take place by one of the usual methods, for example, in the case of textile fabric, by impregnation with a dye solution in an exhaust bath or by spraying onto the fabric or by padding with a padding solution or by printing, for example on a roller printing machine, or by means of the ink-jet printing method.

In the case of slightly water-soluble or water-insoluble dyes, the dye can be dissolved in, for example, a vinyl or acrylate binder and applied as such by padding, spraying and the like. There is also the possibility of applying such dyes to the organic material by padding, spraying or printing in, for example, a vinyl or acrylate emulsion with water.

Ionising radiation is understood to mean radiation which can be detected by means of an ionisation chamber. It consists either of electrically charged, directly ionising particles which produce ions in gases along their trajectory by collision or of uncharged, indirectly ionising particles or photons which produce directly ionising charged secondary particles in matter, such as the secondary electrons of X-rays or $\gamma$-rays or the recoil nuclei (in particular protons) of fast neutrons; slow neutrons which are capable of producing high-energy charged particles by nuclear reactions either directly or via photons from ($\beta$, $\gamma$) processes are also indirectly ionising particles. Suitable heavy charged particles are protons, atomic nuclei or ionised atoms. Of particular importance for the process according to the invention are light charged particles, for example electrons. Suitable X-ray radiation is both the bremsstrahlung and the characteristic radiation. An important corpuscular radiation of heavy charged particles is $\alpha$-radiation.

The ionising radiation can be generated by one of the customary methods. Thus, for example, spontaneous nuclear transformations and also nuclear reactions (enforced nuclear transformations) can be used for generating this radiation. Accordingly, suitable radiation sources are natural or induced radioactive materials and in particular nuclear reactors. The radioactive fission products formed in such reactors by nuclear fission are a further important radiation source.

A further suitable method of generating radiation is by means of an X-ray tube.

Of particular importance are rays consisting of particles accelerated in electric fields. Suitable radiation sources are in this respect thermion, electron-impact ion, low-voltage arc discharge ion, cold cathode ion and high-frequency ion sources.

Of particular importance for the process of the present invention are electron beams. These are produced by acceleration and focusing of electrons which are emitted from a cathode by thermionic, field or photo emission and by electron or ion bombardment. Ion sources are electron guns and accelerators of customary design. Examples of radiation sources are disclosed in the literature, for example International Journal of Electron Beam & Gamma Radiation Processing, in particular 1/89 pages 11–15; Optik, 77 (1987), pages 99–104.

Suitable radiation sources for electron beams are furthermore β-emitters, for example strontium-90.

Other technically advantageously usable ionising rays are γ-rays which can be easily produced using, in particular, caesium-137 or cobalt-60 isotope sources.

Suitable dyes are water-soluble and water-insoluble dyes which carry one polymerisable double bond. This polymerisable group can also be linked to the chromophore via a bridging member, for example a $—(CH_2—CH_2—O)_n$ group.

Water-soluble dyes are understood to mean in particular those having sulfo-containing chromophores. Suitable water-insoluble dyes are disperse dyes containing a polymerisable group and being soluble in the radiation-polymerisable binder.

Suitable polymerisable double bonds are vinyl, chlorovinyl, vinylsulfonyl, allyl, allylsulfonyl, acrylate, methacrylate, acrylamide, methacrylamide, haloacrylamide or styryl groups and derivatives of cinnamic acid.

Dyes which are suitable for this fixation process are those containing at least one activated unsaturated group, in particular an unsaturated aliphatic group, for example a vinyl, halovinyl, styryl, acrylic or methacrylic group, or a polymerisable ring system. Examples of such groups are unsaturated groups containing halogen atoms, such as halomaleic acid and halopropiolic acid radicals, α- or β-bromo- or chloro-acrylic groups, halogenated vinyl acetyl groups, halocrotonylic or halomethacrylic groups. Furthermore, suitable groups are also those which are easily converted, for example by elimination of hydrogen halide, into halogen-containing unsaturated groups, for example a dichloro- or dibromopropionyl group. Halogen atoms are here understood to mean fluorine, chlorine, bromine and iodine atoms and also pseudohalogen atoms, for example a cyano group. The process according to the invention gives good results with dyes containing an α-bromoacrylic group. Suitable dyes containing at least one polymerisable double bond are preferably those containing at least one acryloyl, methacryloyl, α-bromoacryloyl, α-chloroacryloyl, vinyl or vinylsulfonyl radical; very particular preference is given to those containing at least one acryloyl, α-bromoacryloyl or vinylsulfonyl radical. Suitable dyes containing a polymerisable ring system are preferably those containing at least one epoxy radical.

The chromophoric systems used can belong to a wide range of classes of dyes.

In a preferred embodiment of the process according to the invention, the dyes used are those of the formula $$D—(P)_r \qquad (1)$$

in which D is the radical of an organic dye from the monoazo or polyazo, metal complex azo, anthraquinone, phthalocyanine, formazan, azomethine, nitroaryl, dioxazine, phenazine, stilbene, triphenylmethane, xanthene, thioxanthone, naphthoquinone, pyrenequinone or perylenetetracarbimide series, P is a radical having a polymerisable double bond and r is the number 1, 2, 3, 4, 5 or 6.

Preference is given to dyes of the formula $$D'—(P)_r \qquad (1a)$$

in which P and r are as defined above and D' is the radical of an organic monoazo, polyazo, formazan, anthraquinone, phthalocyanine or dioxazine dye.

In a particularly preferred embodiment of the process according to the invention, the dyes used are water-soluble dyes of the formula (1) in which a) D is the radical of an anthraquinone dye of the formula

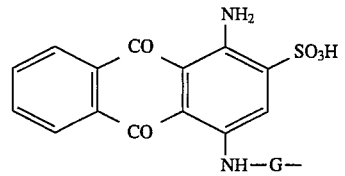

(2)

in which G is a phenylene, cyclohexylene or $C_2$–$C_6$alkylene radical; it being possible for the anthraquinone ring to be substituted by a further sulfo group and for G as phenyl radical to be substituted by alkyl having 1 to 4 C atoms, alkoxy having 1 to 4 C atoms, halogen, carboxyl or sulfo;

b) D is the radical of a phthalocyanine dye of the formula

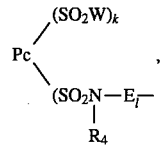

(3)

in which Pc is the radical of a copper phthalocyanine or nickel phthalocyanine; W is —OH and/or $—NR_5R_6$; $R_5$ and $R_6$, independently of one another, are hydrogen or alkyl having 1 to 4 carbon atoms, which may be substituted by hydroxyl or sulfo; $R_4$ is hydrogen or alkyl having 1 to 4 carbon atoms; E is a phenylene radical, which may be substituted by alkyl having 1 to 4 C atoms, halogen, carboxyl or sulfo; or an alkylene radical having 2 to 6 C atoms, preferably a sulfophenylene or ethylene radical; k is 0, 1, 2 or 3; I is 1, 2, 3 or 4 and k+1 is 4;

c) D is the radical of a dioxazine dye of the formulae

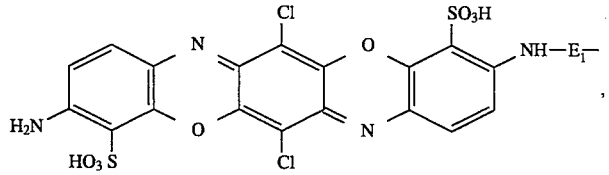

(4)

-continued

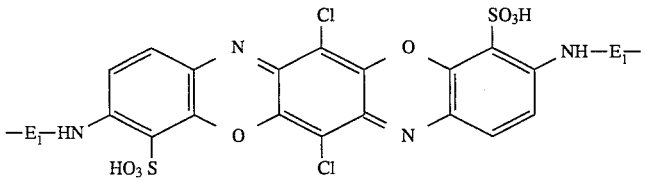

(4a)

or

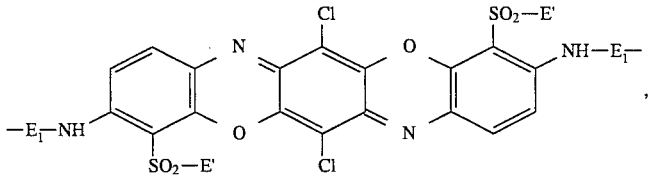

(4b)

in which $E_1$ and E', independently of one another, are a phenylene radical, which may be substituted by alkyl having 1 to 4 C atoms, halogen, carboxyl or sulfo; or an alkylene radical having 2 to 6 C atoms, which may be substituted by amino, carbamoyl, carboxyalkylenecarboxamido, sulfo, sulfamoyl and sulfato; and the outer benzene rings in formulae (4) to (4b) may be further substituted by alkyl having 1 to 4 C atoms, alkoxy having 1 to 4 C atoms, acetylamino, nitro, halogen, carboxyl or sulfo.

Dyes of the formula (1) in which D is the radical of an azo dye, in particular a radical of formulae (5) to (5i), are also particularly preferably used:

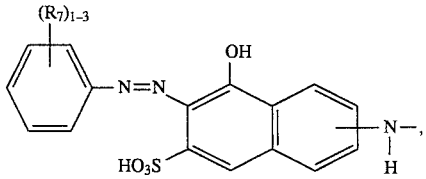

(5)

in which $(R_7)_{1-3}$ is 1 to 3 substituents from the group consisting of $C_{1-4}$alkyl, $C_{1-4}$alkoxy, halogen, carboxyl and sulfo;

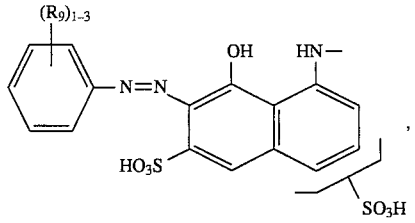

(5a)

in which $(R_9)_{1-3}$ is 1 to 3 substituents from the group consisting of $C_{1-4}$alkyl, $C_{1-4}$alkoxy, halogen, carboxyl and sulfo;

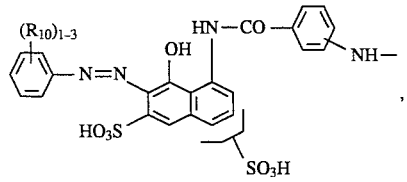

(5b)

in which $(R_{10})_{1-3}$ is 1 to 3 substituents from the group consisting of $C_{1-4}$alkyl, $C_{1-4}$alkoxy, halogen, carboxyl and sulfo;

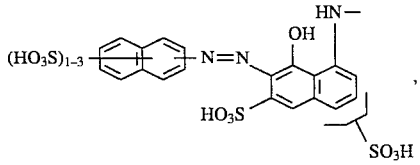

(5c)

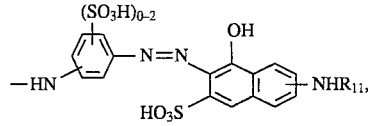

(5d)

in which $R_{11}$ is $C_{2-4}$alkanoyl or benzoyl;

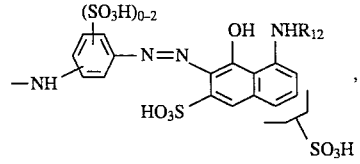

(5e)

in which $R_{12}$ is $C_{2-4}$alkanoyl or benzoyl;

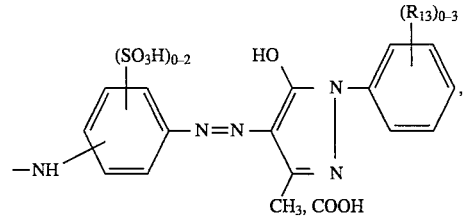

(5f)

in which $(R_{13})_{0-3}$ is 0 to 3 substituents from the group consisting of $C_{1-4}$alkyl, $C_{1-4}$alkoxy, halogen, carboxyl and sulfo;

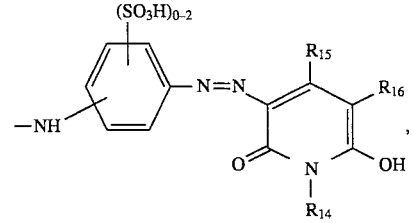

(5g)

in which $R_{14}$ and $R_{15}$, independently of one another, are hydrogen, $C_{1-4}$alkyl or phenyl, and $R_{16}$ is hydrogen, cyano, carbamoyl or sulfomethyl:

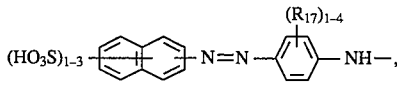

(5h)

in which $(R_{17})_{1-4}$ is 1 to 4 substituents from the group consisting of hydrogen, halogen, nitro, cyano, trifluoromethyl, sulfamoyl, carbamoyl, $C_{1-4}$alkyl, $C_{1-4}$alkoxy, amino, acetylamino, ureido, hydroxyl, carboxyl, sulfomethyl and sulfo, each $R_{17}$ being independent of the others;

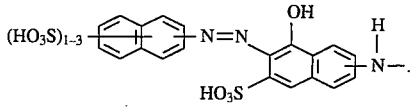

(5i)

In a further preferred embodiment of the process according to the invention, the water-insoluble or sparingly water-soluble dyes are azo dyes of the formula

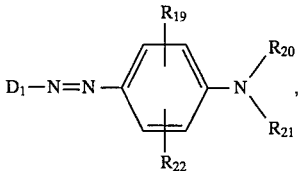

(6)

in which $D_1$ is the radical of a carbocyclic or heterocyclic diazo component which is free of water-solubilising substituents;

$R_{19}$ is chlorine, methyl, methoxy, methoxyethyl, methoxyethoxy or hydrogen;

$R_{20}$ and $R_{21}$, independently of one another, are $C_1$-$C_6$alkyl, $C_3$–$C_6$alkenyl, phenyl or the radical $—B_1—P_1$;

$R_{22}$ is hydrogen, methyl, methoxy, chlorine, bromine or the radical $P_1$;

$P_1$ is a radical having a polymerisable double bond;

$B_1$ is a substituted or unsubstituted radical of the formula $—(CH_2)_b—(C_6H_4)_c—(CH_2)_o—$;

in which b is an integer from 1 to 6;

c is 0 or 1 and o is an integer from 0 to 6;

and at least one of the radicals $R_{20}$, $R_{21}$ or $R_{22}$ is $P_1$ or is substituted by a radical $P_1$.

$D_1$ is preferably the radical of a homo- or heterocyclic diazo component, for example from the thienyl, phenylazothienyl, thiazolyl, isothiazolyl, 1,2,4-thiadiazolyl, 1,3,4-thiadiazolyl, benzothiazolyl, benzoisothiazolyl, pyrazolyl, 1,2,3-triazolyl, 1,2,4-triazolyl, imidazolyl, or phenyl series. Each of these systems can carry further substituents, such as alkyl, alkoxy or alkylthio each having 1 to 4 carbon atoms, phenyl, electro-negative groups, such as halogen, in particular chlorine or bromine, trifluoromethyl, cyano, nitro, acyl, for example acetyl or benzoyl, carbalkoxy, in particular carbomethoxy or carbethoxy, alkylsulfonyl having 1 to 4 carbon atoms, phenylsulfonyl, phenoxysulfonyl, sulfonamido or arylazo, in particular phenylazo. Any two adjacent substituents of the ring systems mentioned can also together form further fused-on rings, for example phenyl rings or cyclic imides.

$D_1$ is particularly preferably a benzothiazolyl, benzoisothiazolyl or phenyl radical, which is unsubstituted or mono- or disubstituted by one of the abovementioned radicals.

The alkyl radicals can be substituted, for example by hydroxyl, alkoxy having 1 to 4 carbon atoms, in particular methoxy, cyano or phenyl. Further suitable substituents are halogen, such as fluorine, chlorine or bromine, or —CO—U or —O—CO—U, in which U is alkyl having 1 to 6 carbon atoms or phenyl.

Suitable alkenyl radicals are those derived from the abovementioned alkyl radicals by replacing at least one single bond by a double bond. Examples of suitable radicals are ethenyl or propenyl.

Phenyl radicals are understood to mean substituted or unsubstituted phenyl radicals. Examples of suitable substituents are $C_1$–$C_4$alkyl, $C_1$–$C_4$alkoxy, bromine, chlorine, nitro or $C_1$–$C_4$alkylcarbonylamino.

Examples of the radical P are radicals derived from acrylic acid, methacrylic acid or cinnamic acid. Particular mention may be made of the radicals of the formulae $—CO—CH=CH_2$, $—CO—C(CH_3)=CH_2$, —CO—CBr=CH2, $—CO—CCl=CH_2$, $—CO—CH=CH—C_6H_5$, $—O—CO—CH=CH_2$, $—O—CO—C(CH_3)=CH_2$, $—O—CO—CBr=CH_2$, $—O—CO—CH=CH—C_6H_5$, $—CH=CH_2$, $—CH=CH—C_6H_5$, $—C(CH_3)=CH_2$, $—SO_2—CH=CH_2$, $—O—CO—CCl=CH_2$ or $—C_6H_4—SO_2—CH=CH_2$.

Particular preference is given to dyes of the formulae:

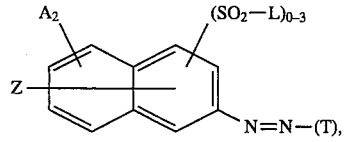

(11)

in which

L is OH or

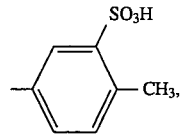

(12)

$A_2$ is hydrogen or $C_1$–$C_3$alkyl,

T is a radical of the formula

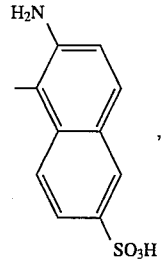

(13)

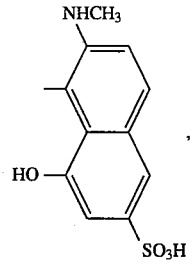

(14)

-continued
(15)
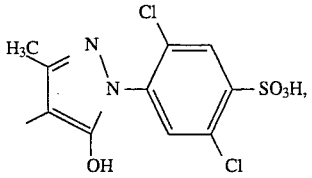
(16)
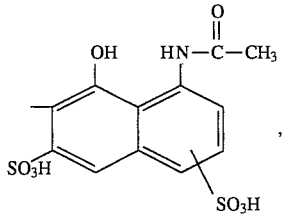
(17)
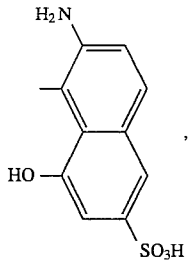
(18)
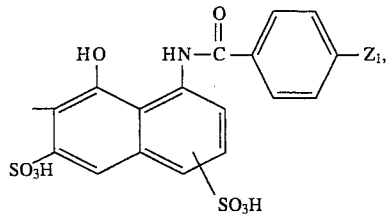
(19)
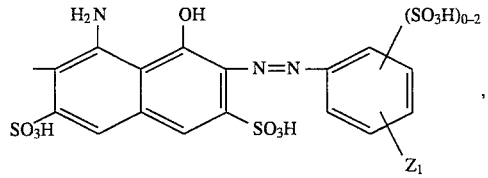
(20)
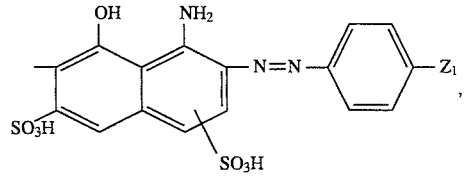
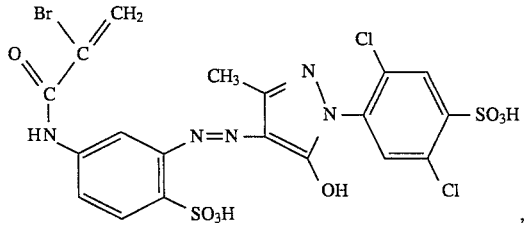
-continued
(21)
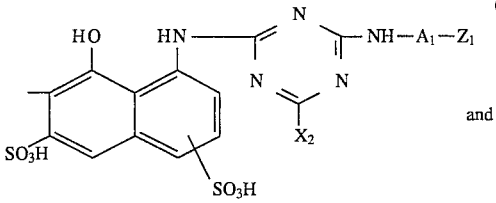
and
(22)
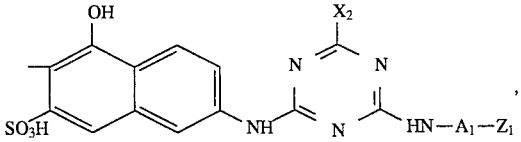
Z and $Z_1$, independently of one another, are hydrogen or radicals of the formulae
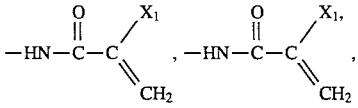
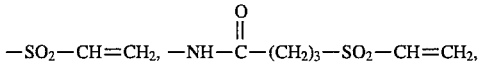
$X_2$ is chlorine or fluorine,
$X_1$ and $X_1$, are independently of one another hydrogen, chlorine, bromine or methyl and $A_1$ is a direct bond, $—C_2H_4—O—C_2H_4—$,
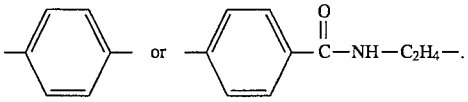
Examples of the above dyes are dyes of the formulae:
(23)

-continued
(24)
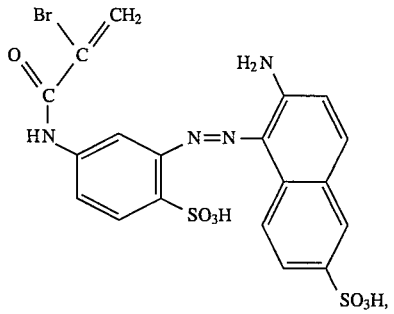
(25)
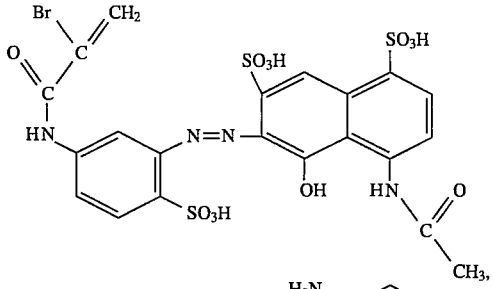
(26)
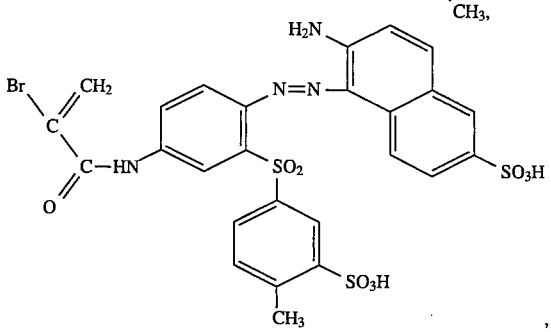
(27)
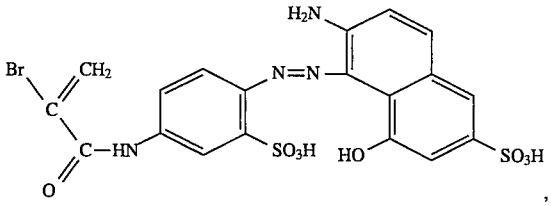
(28)
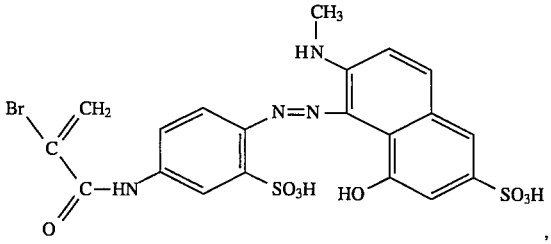
(29)
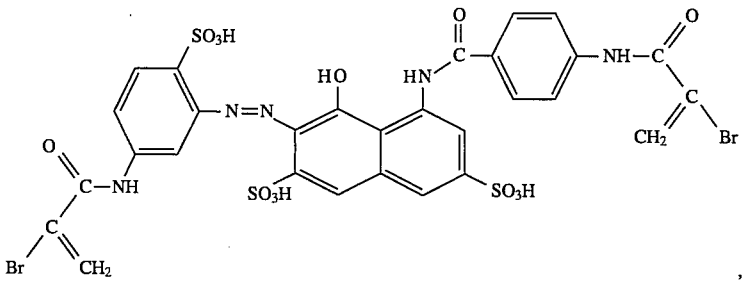

-continued
(30)
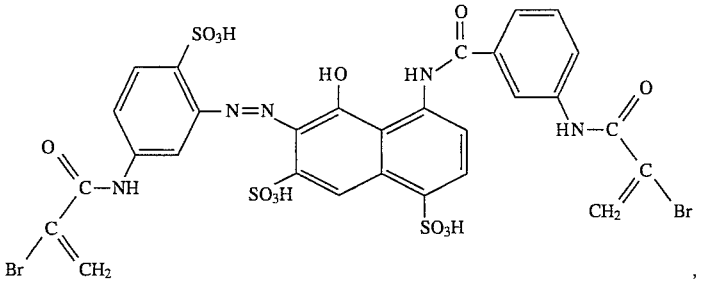
(31)
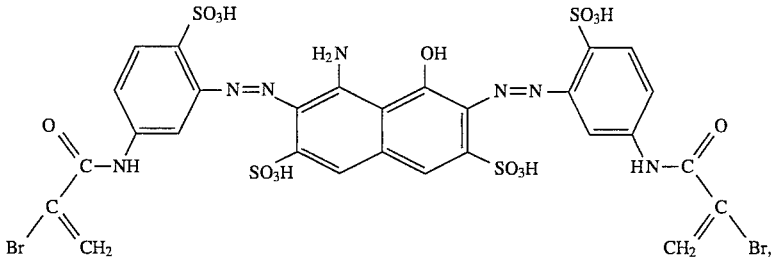
(32)
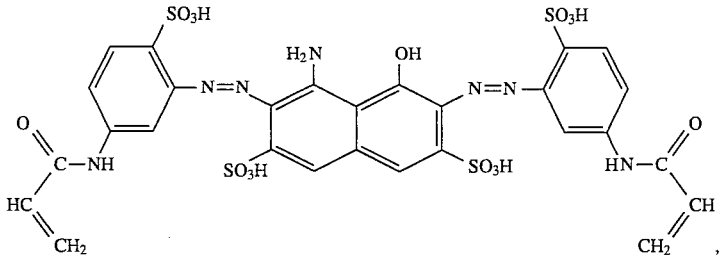
(33)
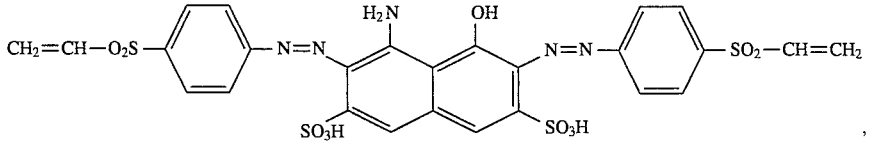
(34)
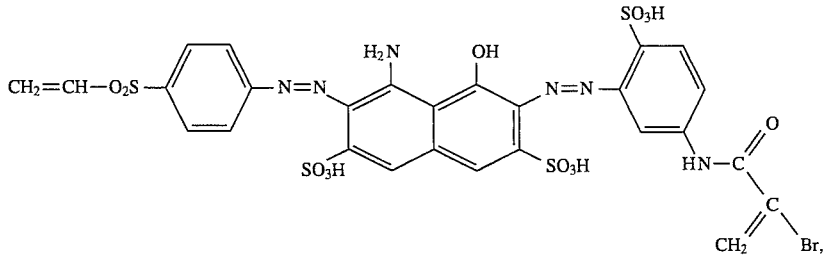
(35)
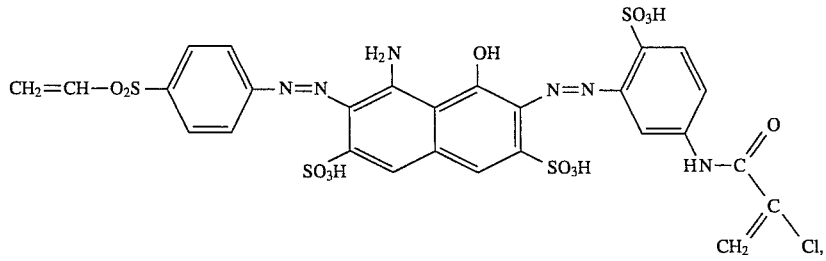

-continued
(36)
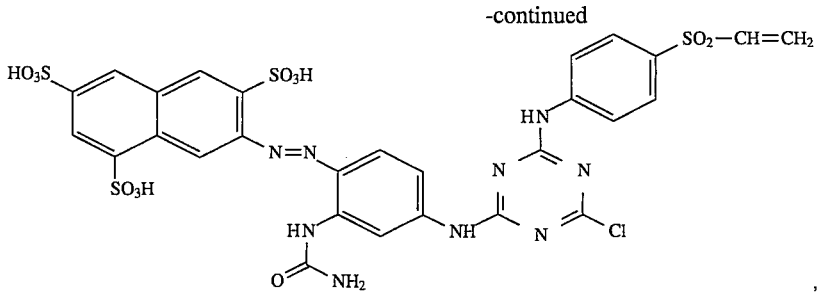
(37)
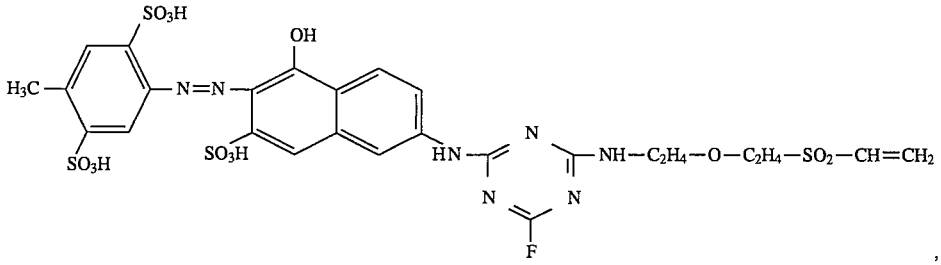
(38)
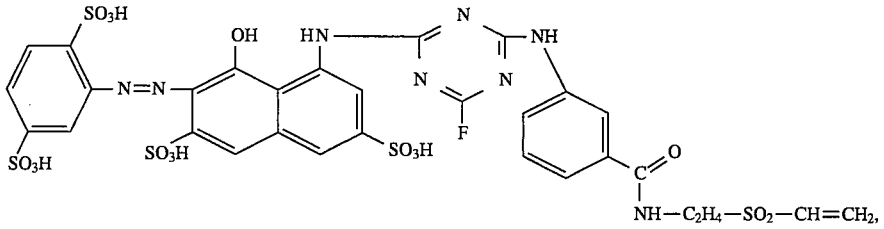
(39)
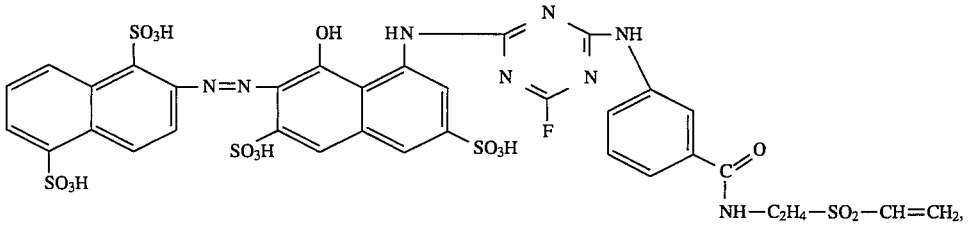
(40)
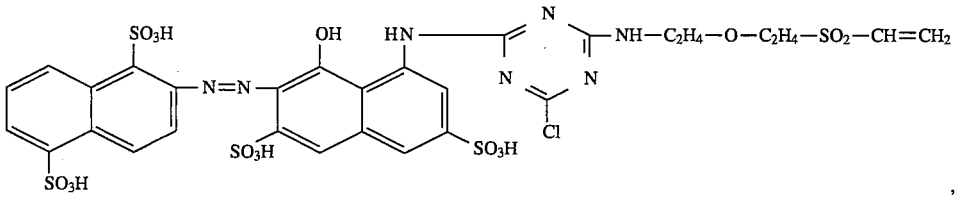
(41)
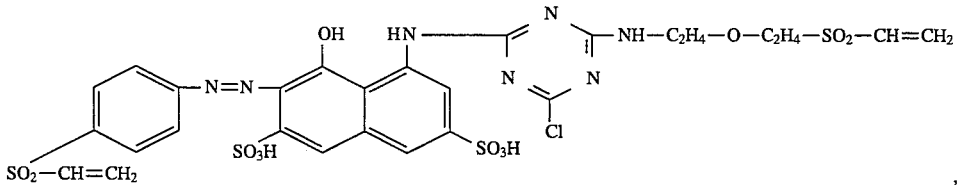
(42)
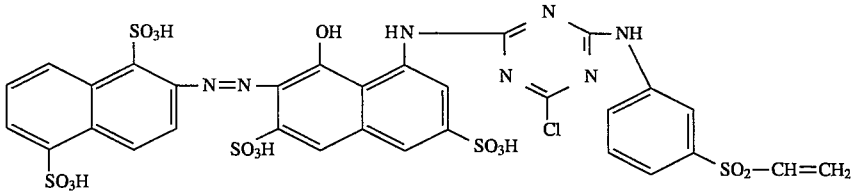
and -continued
(43)
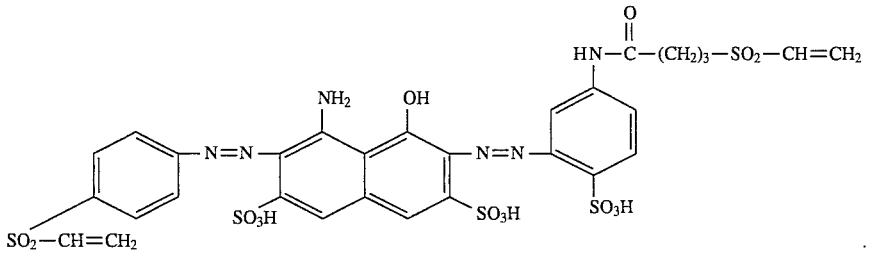
Further preferred dyes are formazan dyes of the formula
(44)
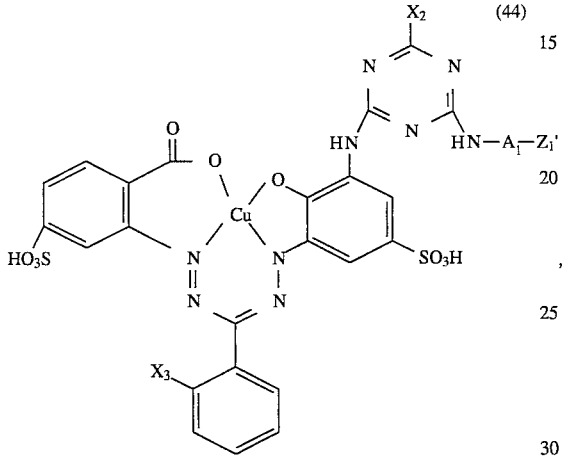
in which
$Z_{1'}$ is a radical of the formulae
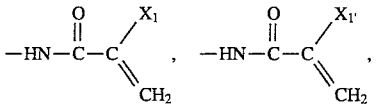
$-SO_2-CH=CH_2$,
-continued
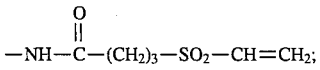
$X_1$ and $X_{1'}$ are independently of one another hydrogen, chlorine, bromine or methyl,
$X_2$ is chlorine or fluorine and
$X_3$ is hydrogen or $SO_3H$,
$A_1$ is a direct bond, $-C_2H_4-O-C_2H_4-$,
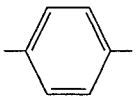
or
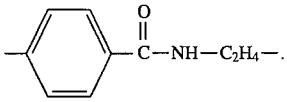
Examples of the above dyes are the dyes of the formulae:
(44a)
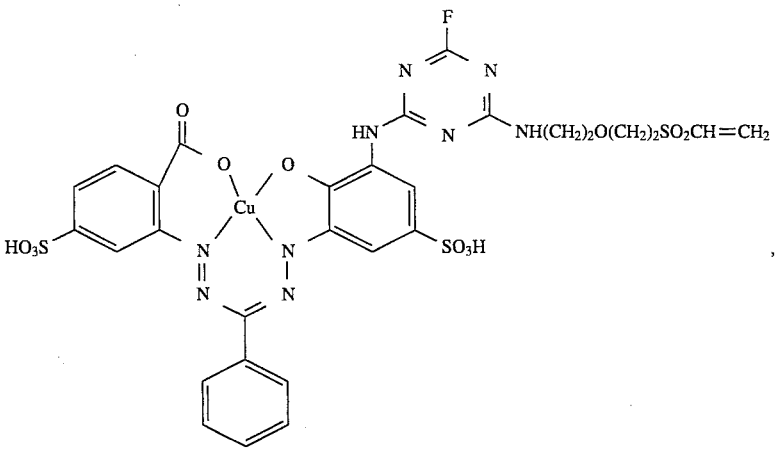

-continued (44b)

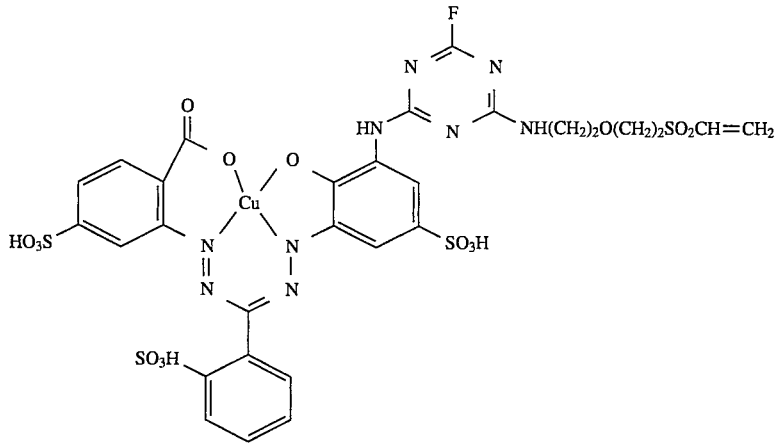

and (44c)

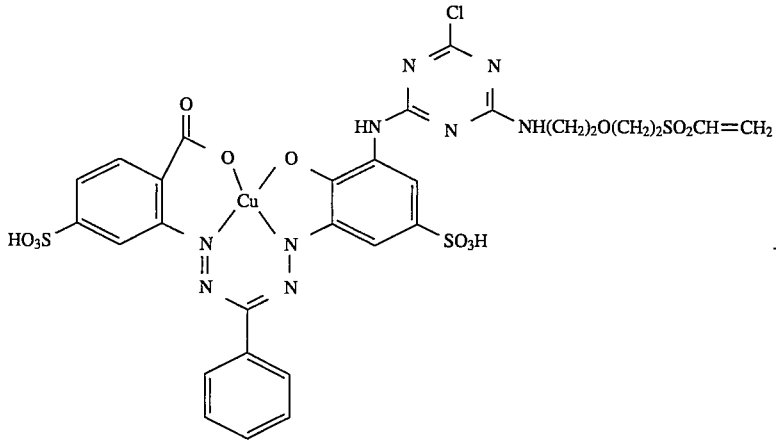

Further preferred dyes are sparingly water-soluble or water-insoluble dyes from the anthraquinone series, for example (2a)

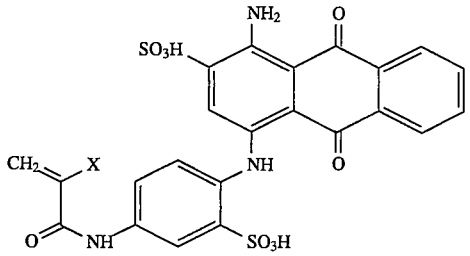

in which

X is hydrogen, chlorine, bromine or methyl.

The dyes mentioned are known or can be prepared by known methods.

The cationic compounds to be used are advantageously colourless or almost colourless quaternary ammonium salts which also carry at least one polymerisable double bond, or mixtures thereof. Preference is given to those of the general formula $$(R_1R_2R_{2'}R_{2''}N)_m^+(A)^{m-}, \quad (7)$$

in which $R_1$ is a radical of the formula $$CH_2{=}CX{-}Y{-}Q{-} \quad (7a)$$

in which

X is hydrogen, $C_{1-2}$alkyl or halogen,

Y is —CO—O—, —CO—NH— or a direct bond,

Q is $-CH_2-CHOH-CH_2-$, $-(CH_2)_t-$ or $-(CH_2-CH_2-O)_t-CH_2-CH_2-$,

A is an anion from the group consisting of halides, sulfates, alkyl$_{1-2}$sulfates, thiosulfates, phosphates, carboxylates and sulfonates, $R_2$, $R_{2'}$ and $R_{2''}$, independently of one another, are hydrogen, $C_{1-24}$alkyl or $R_1$, or the quaternary nitrogen atom in formula (7) can also be a member of an N-heterocyclic ring, which is substituted or unsubstituted and can contain further hetero atoms, m is 1, 2 or 3 and t is an integer between 1 and 20.

Particularly preferably, quaternary ammonium salts of the formula $$CH_2{=}CH{-}CO{-}O{-}CH_2{-}CH_2{-}N(CH_3)_3^{+}A^- \quad (7b)$$

$$CH_2{=}C(CH_3){-}CO{-}O{-}CH_2{-}CH_2{-}N(CH_3)_3^{+}A^- \quad (7c)$$

$$CH_2{=}C(CH_3){-}CO{-}NH{-}CH_2{-}CH_2{-}CH_2{-}N(CH_3)_3^{+}A^- \quad (7d)$$

or $$CH_2{=}C(CH_3){-}CO{-}O{-}CH_2{-}CHOH{-}CH_2{-}N(CH_3)_3^{+}A^- \quad (7e)$$

are used, in which A is as defined above.

A further example of such quaternary compounds is the compound of the formula $$(CH_3)_2(CH_2{=}CHCH_2)_2N^+A^- \quad (7f)$$

The nonionic compounds to be used are polymerisable colourless or almost colourless, for example, possibly slightly yellowish, monomeric, oligomeric or polymefic compounds or mixtures thereof; for example N-$C_{1-4}$alkylolacrylamide, N-butoxymethylacrylamide, N-isobutoxymethylacrylamide, N-$C_{1-4}$alkylolmethacrylamide, N-butoxymethyl-methacrylamide, N-isobutoxymethylmethacrylamide, N,N-di($C_{1-4}$alkylol)acrylamide, N,N-di(butoxymethyl)acrylamide, N,N-di(isobutoxymethyl)acrylamide, N,N-di($C_{1-4}$methylol)methacrylamide, N,N-di(butoxymethyl)methacrylamide, N,N-di(isobutoxymethyl)methacrylamide.

Preferably, the colourless compounds used in the process according to the invention are monomeric, oligomeric or polymeric organic compounds or mixtures thereof.

Particularly preferably, the nonionic colourless compounds used in the process according to the invention are acrylates, diacrylates, triacrylates, polyacrylates, acrylic acid, methacrylates, dimethacrylates, trimethacrylates, polymethacrylates, methacrylic acid, acrylamide and acrylamides, diacrylamides, methacrylamide and methacrylamides and dimethacrylamides.

Very particularly preferably, mixtures of monomeric and oligomeric colourless organic compounds are used in the process according to the invention.

Very particularly preferably, diacrylates of the general formula $$CH_2{=}CR_3{-}CO{-}O{-}(CH_2{-}(CH_2{-}O)_n{-}CO{-}CR_3{=}CH_2 \quad (9)$$

are used, in which $R_3$ is hydrogen or $C_{1-2}$alkyl and n is an integer between 1 and 12.

Also used particularly preferably are acrylates of the formula $$CH_2{=}CR_3{-}Y{-}Q{-}R_{18} \quad (10)$$

in which

Y, Q and $R_3$ are as defined above and $R_{18}$ is 2-oxazolidon-3-yl.

The colourless nonionic compounds containing at least one polymerisable double bond are free of colouring radicals. They are monomeric, oligomeric or polymeric organic compounds or a mixture thereof, which can be polymerised or crosslinked.

A suitable monomeric colourless compound is one having a molecular weight of up to about 1000 and containing at least one polymerisable group.

Bi-, tri- and polyfunctional monomers are also suitable.

The monomeric colourless compound can either be used directly by itself or else as a mixture with other monomers, oligomers and/or polymers.

A suitable oligomeric colourless compound is one having a molecular weight of between 1000 and 10000 and containing one or more polymerisable groups. The oligomeric colourless compound can, if liquid, be used directly by itself or as a solution in water or organic solvents or as a mixture with other monomers, oligomers and/or polymers.

A suitable polymeric colourless compound is one having a molecular weight of >1000() and containing one or more polymerisable groups.

The polymeric colourless compound can, if liquid, be used directly by itself or as a solution in water or organic solvents or as mixture with other monomers, oligomers and/or polymers.

Suitable colourless compounds are ethylenically unsaturated monomeric, oligomeric and polymeric compounds.

Examples of particularly suitable compounds are esters of ethylenically unsaturated carboxylic acids and polyols or polyepoxides, and polymers having ethylenically unsaturated groups in the chain or in side groups, for example unsaturated polyesters, polyamides and polyurethanes and copolymers thereof, polybutadiene and butadiene copolymers, polyisoprene and isoprene copolymers, polymers and copolymers containing (meth)acrylic groups in side chains, and mixtures of one or more of such polymers.

Examples of unsaturated carboxylic acids are acrylic acid, methacrylic acid, crotonic acid, iraconic acid, cinnamic acid and unsaturated fatty acids, such as linolenic acid or oleic acid. Acrylic acid and methacrylic acid are preferred.

Suitable polyols are aliphatic and cycloaliphatic polyols. Examples of polyepoxides are those based on polyols and epichlorohydrin. Furthermore, polymers or copolymers containing hydroxyl groups in the polymer chain or in side groups, for example polyvinyl alcohol and copolymers thereof or poly(hydroxyalkyl methacrylate)s or copolymers thereof are also suitable polyols. Further suitable polyols are hydroxyl-terminated oligoesters.

Examples of aliphatic and cycloaliphatic polyols are alkylenediols having preferably 2 to 12 C atoms, such as ethylene glycol, 1,2- or 1,3-propanediol, 1,2-, 1,3- or 1,4-butanediol, pentanediol, hexanediol, octanediol, dodecanediol, diethylene glycol, triethylene glycol, polyethylene glycol having molecular weights of, preferably, 200 to 1500, 1,3-cyclopentanediol, 1,2-, 1,3-or 1.4-cyclohexanediol, 1.4-dihydroxymethylcyclohexane, glycerol, tris(β-hydroxyethyl)amine, trimethylolethane, trimethylolpropane, pentaerythritol, dipentaerythritol and sorbitol.

The polyols can be partially or completely esterified with one or various unsaturated carboxylic acids, it being possible for the free hydroxyl groups in partial esters to be modified, for example esterified, or esterified with other carboxylic acids.

Examples of esters are:

trimethylolpropane triacrylate, trimethylolethane triacrylate, trimethylolpropane trimethacrylate, trimethylolethane trimethacrylate, tetramethylene glycol dimethacrylate, triethylene glycol dimethacrylate, tetraethylene glycol diacrylate, pentaerythritol diacrylate, pentaerythritol triacrylate, pentaerythritol tetraacrylate, dipentaerythritol diacrylate, dipentaerythritol triacrylate, dipentaerythritol tetraacrylate, dipentaerythritol pentaacrylate, dipentaerythritol hexaacrylate, tripentaerythritol octaacrylate, pentaerythritol dimethacrylate, pentaerythritol trimethacrylate, dipentaerythritol dimethacrylate, dipentaerythritol tetramethacrylate, tripentaerythritol octamethacrylate, pentaerythritol diitaconate, dipentaerythritol trisitaconate, dipentaerythritol pentaitaconate, dipentaerythritol hexaitaconate, ethylene glycol dimethacrylate, 1,3-butanediol diacrylate, 1,3-butanediol dimethacrylate, 1,4-butanediol diitaconate, sorbitol triacrylate, sorbitol tetraacrylate, modified pentaerythritol triacrylate, sorbitol tetramethacrylate, sorbitol pentaacrylate, sorbitol hexaacrylate, oligoester acrylates and oligoester methacrylates, glycerol diacrylate and glycerol triacrylate, 1,4-cyclohexane diacrylate, bisacrylates and bismethacrylates of polyethylene glycol of molecular weight 200—1500, or mixtures thereof.

Suitable colourless compounds are also the amides of the same or different unsaturated carboxylic acids of aromatic, cycloaliphatic and aliphatic polyamines having preferably 2 to 6, in particular 2 to 4, amino groups. Examples of such polyamines are ethylenediamine, 1,2-or 1,3-propylenediamine, 1,2-, 1,3-or 1,4-butylenediamine, 1,5-pentylenediamine, 1,6-hexylendiamine, octylenediamine, dodecylenediamine, 1,4-diaminocyclohexane, isophoronediamine, phenylenediamine, bisphenylenediamine, di-β-aminoethyl ether, diethylenetriamine, triethylenetetraamine, di(β-aminoethoxy)- or di(β-aminopropoxy)ethane. Further suitable polyamines are polymers and copolymers having amino groups in the side chain and amino-terminated oligoamides.

Examples of such unsaturated amides are: methylenebisacrylamide, 1,6-hexamethylenebisacrylamide, N,N',N''-trismethacryloyldiethylenetriamine, bis(methacrylamidopropoxy)ethane, β-methacrylamidoethyl methacrylate, N-[(β-hydroxyethoxy)ethyl]lacrylamide.

Suitable unsaturated polyesters and polyamides are derived, for example, from maleic acid and diols or diamines. Maleic acid can be replaced in part by other dicarboxylic acids. They can be used together with ethylenically unsaturated comonomers, for example styrene. The polyesters and polyamides can also be derived from dicarboxylic acids and ethylenically unsaturated diols or diamines, in particular from longer-chain ones having, for example, 6 to 20 C atoms. Examples of polyurethanes are those synthesised from saturated or unsaturated diisocyanates and unsaturated or saturated diols.

Polybutadiene and polyisoprene and copolymers thereof are known. Examples of suitable comonomers are olefins, such as ethylene, propene, butene, hexene, (meth)acrylates, acrylonitrile, styrene or vinyl chloride. Polymers containing (meth)acrylate groups in the side chain are also known. They can, for example, be reaction products of novolak-based epoxy resins with (meth)acrylic acid, homo- or copolymers of polyvinyl alcohol or hydroxyalkyl derivatives thereof esterified with (meth)acrylic acid, or homo- and copolymers of (meth)acrylates esterified with hydroxyalkyl (meth)acrylates.

The colourless compounds can be used alone or in any desired mixtures.

Examples of oligomeric or polymeric colourless compounds are preferably various polyester acrylates, for example $CH_2{=}CH{-}[CO{-}O(CH_2)_n]{-}CO{-}O{-}CH{=}CH_2$, epoxy acrylates, for example $CH_2{=}CH{-}CO{-}O{-}CH_2{-}CHOH{-}CH_2{-}O{-}C_6H_4)_2C\ (CH_3)_2$, urethane acrylates, for example $$\begin{array}{l} CH_2{=}CH{-}CO{-}O{-}CH_2CH_2{-}O{-}CO{-}NH{-}(CH_3){-}C_6H_3{-}NH{-}CO{-}O{-}(CH_2)_6{-}CO \\ \qquad\qquad\qquad\

Likewise, preference is given to the combinations of the quaternary ammonium salts of the formula

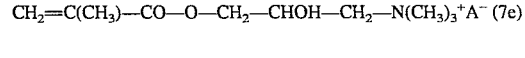

$$CH_2{=}CH{-}CO{-}O{-}CH_2{-}CH_2{-}N(CH_3)_3{}^+A^- \quad (7b)$$

$$CH_2{=}C(CH_3){-}CO{-}O{-}CH_2{-}CH_2{-}N(CH_3)_3{}^+A^- \quad (7c)$$

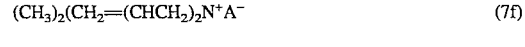

$$CH_2{=}C(CH_3){-}CO{-}NH{-}CH_2{-}CH_2{-}CH_2{-}N(CH_3)_3{}^+A^{31} \quad (7d)$$

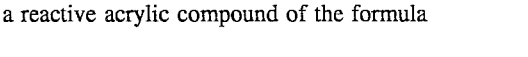

$$CH_2{=}C(CH_3){-}CO{-}O{-}CH_2{-}CHOH{-}CH_2{-}N(CH_3)_3{}^+A^- \quad (7e)$$

or

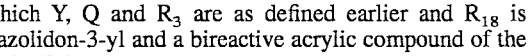

$$(CH_3)_2(CH_2{=}(CHCH_2)_2N^+A^- \quad (7f)$$

with a reactive acrylic compound of the formula

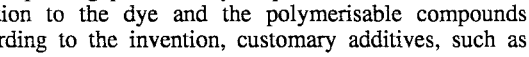

$$CH_2{=}CR_3{-}Y{-}Q{-}R_{18} \quad (10)$$

in which Y, Q and $R_3$ are as defined earlier and $R_{18}$ is 2-oxazolidon-3-yl and a bireactive acrylic compound of the formula (9a).

The printing pastes or dye liquors can also contain, in addition to the dye and the polymerisable compounds according to the invention, customary additives, such as thickeners, dyeing assistants, fillers, dispersants, lubricants, antioxidants and polymerisation inhibitors. The polymerisable compounds usually also contain the latter as stabilisers.

The process according to the invention can be applied to a wide range of fibres, for example fibres of animal origin, such as wools, silks, hair (for example in the form of felt) or regenerated fibres, such as regenerated protein fibres or alginate fibres, synthetic fibres, such as polyvinyl, polyacrylonitrile, polyester, polyamide, aramid, polypropylene or polyurethane fibres and in particular cellulose-containing materials, such as bast fibres, for example linen, hemp, jute, ramie and, in particular, cotton, and cellulose synthetic fibres, such as viscose or modal fibres, cuprammonium, nitrocellulose or hydrolysed acetate fibre or fibres made of cellulose acetate, such as acetate fibre, or fibres made of cellulose triacetate, such as Arnel®, Trilan®, Courpleta® or Tricel®.

The fibres mentioned can be present in forms such as are used in particular in the textile industry, for example as filaments or yarns, or as woven fabrics, knitted fabrics or nonwoven materials, such as felts.

The fibre material used in the process according to the invention is preferably wool, silk, hair, alginate fibres, polyvinyl, polyacrylonitrile, polyester, polyamide, aramid, polypropylene or polyurethane fibres or cellulose-containing fibres.

Particularly preferably, cellulose fibres and polyester/cellulose blend fabrics are used.

Treatment of the material to be dyed with a dye according to the definition can take place in the usual manner, for example, in the case of a textile fabric, by impregnation with a dye solution in an exhaust bath or by spraying onto the fabric or by padding with a padding solution, or by printing, for example on a screen printing machine, or by means of the ink-jet printing method.

Application of the dye and colourless compounds can take place jointly as a homogeneous solution, suspension, emulsion or foam by customary methods. The dyed fibre material can be irradiated while wet, moist or dry.

In general, the colourless compounds and the remaining additives are applied to the material to be dyed together with the dye. However, it is also possible to apply the colourless compounds separately, for example in the form of a pre- or after-treatment.

Emulsion-printing processes in which the mixture of the radiation-polymerisable compounds replaces the hydrophobic component, so that neither varnish makers and painters naphtha nor thickeners are required, are also advantageous.

The process is suitable in particular for carrying out continuous dyeing and fixation processes, although the process or individual steps thereof can also be carried out batchwise.

The process according to the invention is carded out such that, for example, the textile material which has been dyed and treated with a solution of a colourless compound is passed through the beam of an electron accelerator at room temperature. This is done at such a rate that a specified dosage of irradiation is achieved. The dosages of irradiation generally to be used are between 0.1 and 15 Mrad, the dosage of irradiation being advantageously between 0.1 and 4 Mrad. At a dosage of less than 0.1 Mrad, the degree of fixation is in general too low, while at a dosage of more than 15 Mrad the fibre material and the dye are frequently damaged. The dye concentrations of the dye solutions or printing pastes used can be selected such as in conventional dyelag or printing processes, for example 0.001 to 10 per cent by weight, relative to the fibre material used. After the treatment with ionising radiation, the dyed or printed material only needs to be dried. The obtainable degrees of fixations are high, for example more than 90%. The process according to the invention provides dyeings having generally good properties, for example good wash fastness and lightfastness properties.

When carrying out the process according to the invention, the technical preconditions given in each case must of course be taken into consideration. Thus, the specific embodiment depends in particular on the type of ionising rays to be used and their mode of generation. For example, in the case where a yarn reel impregnated with a dye solution and a solution of the colourless compound is to be irradiated with γ-rays, it is enclosed in a cell and exposed to the radiation. In the case where higher dosages of irradiation in combination with a low intensity of radiation is desired, the material to be irradiated can be exposed to the radiation in a plurality of stages.

In order to prevent oxidative destruction of the dye, it is advantageous to carry out irradiation in an inert protective gas atmosphere, for example under nitrogen.

In a preferred embodiment of the process according to the invention, not only fixation of the fibre material containing suitable dye but also dyeing or printing are carded out continuously.

The invention furthermore relates to preparations comprising a dye containing at least one polymerisable double bond or at least one polymerisable ring system, at least one colourless cationic compound containing at least one polymerisable double bond, and, if desired, a colourless nonionic compound containing at least one polymerisable double bond. Preferred compositions contain those preferred individual components such as detailed in the description of the dyes and of the colourless compounds. These compositions can contain further additives such as are customary for dyeing or printing. These compositions are also understood to mean printing pastes which are suitable for emulsion printing.

Preference is given to compositions comprising (a) 5–30 parts by weight of a dye, (b) 5–70 parts by weight of a colourless cationic compound and (c) 0–60 parts by weight of a nonionic colourless compound, relative to 100 parts by weight of the preparation.

Particular preference is given to preparations comprising

10–20 parts by weight of component (a),

10–60 parts by weight of component (b) and

0–60 parts by weight of component (c), relative to 100 parts by weight of the preparation.

Very particular preference is given to preparations comprising 5 to 30 parts by weight of a dye of the given formula (11) or of a dye of the given formula (44) or of a dye of the given formula (2a) as component (a), 5 to 70 parts by weight of a quatemary ammonium salt of the formula (7b–7f), in which $A^-$ is chloride or methylsulfate, as component (b) and 0 to 60 parts by weight of an oligoethylene glycol diacrylate as component (c), relative to 100 parts by weight of the preparation.

Very particular preference is also given to preparations comprising 10 to 20 parts by weight of a dye of the given formula (11) or of a dye of the given formula (44 ) or of a dye of the given formula (2a ) as component (a), 10 to 60 parts by weight of a quaternary ammonium salt of the formula (7b–7f), in which $A^-$ is chloride or methylsulfate, as component (b) and 0 to 60 parts by weight of an oligoethylene glycol diacrylate as component (c), relative to 100 parts by weight of the preparation.

To prepare a dye liquor or printing paste, the concentrated preparations described can be diluted to any desired required dye concentration, it being possible for the nonionic colourless component (c), if not already contained in the preparations, either to be added to the liquor in concentrations of 50–125 g/l or to have been previously applied to the fibre material in concentrations of 30–90 g/kg.

The examples which follow serve to illustrate the invention. Therein, parts and percentages are by weight. Temperatures are given in degrees Celsius. Parts by weight relate to parts by volume as the gram relates to the cubic centimetre.

In the exemplary embodiments which follow, the dosages of irradiation are expressed in the usual manner in Mrad (Megarad), 1 rad corresponding to an absorption of $10^{-2}$ J/kg (Joule/kg).

The fabric mentioned in the examples which follow is printed on one side or dyed by the pad-batch mepad-patch method and irradiated with accelerated electrons under a protective gas atmosphere. Prints are irradiated on one side, while dyeings are irradiated on both sides in two runs. After irradiation, the dyeings or prints are washed in a manner customary for reactive dyes.

The degrees of fixation are determined by stripping the dye from an irradiated unwashed and an unirradiated punched specimen (2.5 cm )$^2$ in size. The specimens are treated once at room temperature with 25 ml of a solution of 600 ml/l of phosphate buffer (pH 7) and 40 ml/l of tetramethylurea in deionised water for 20 minutes and then once at 100° C. with 25 ml of the solution for 20 minutes. Both extracts of each specimen are combined and measured by spectroscopy. The degrees of fixation are determined from the absorbances ($\gamma_{max}$) of the extracts of the corresponding punched specimens.

The oligoethylene glycol diacrylate used has an average molecular weight of 508 g/mol.

EXAMPLE 1

A cotton satin fabric is padded with an aqueous solution comprising 30 g/l of a dye of the formula

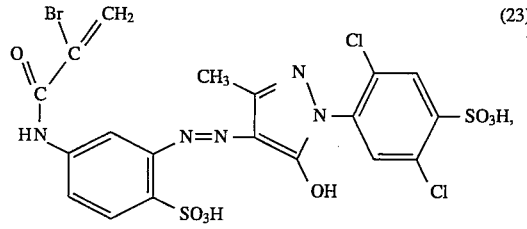

(23)

100 g/l of an oligoethylene glycol diacrylate, 86 g/l of $CH_2{=}C(CH_3){-}CO{-}O{-}(CH_2)_2{-}N(CH_3)_3^{+Cl-}$ and 100 g/l of urea (liquor pick-up about 70%). The fabric is dried and then irradiated on one side with a dosage of 2 Mrad. This gives a brilliant yellow dyeing having a degree of fixation of 94%.

EXAMPLE 2

A cotton satin fabric is padded with an aqueous solution comprising 30 g/l of a dye of the formula

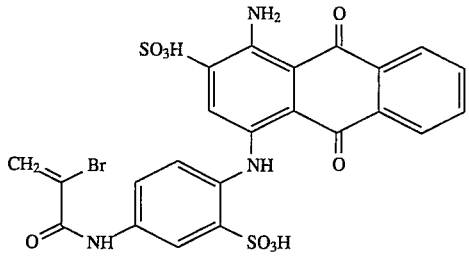

(2a')

100 g/l of an oligoethylene glycol diacrylate, 86 g/l of $CH_2{=}C(CH_3){-}CO{-}O{-}(CH_2)_2{-}N(CH_3)_3^{+}Cl^-$ and 100 g/l of urea (liquor pick-up about 70% ). The fabric is dried and then irradiated on one side with a dosage of 2 Mrad. This gives a brilliant blue dyeing having a degree of fixation of 91%.

EXAMPLE 3

A cotton satin fabric is padded with an aqueous solution comprising 30 g/l of a dye of the formula

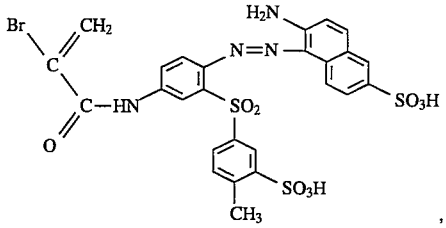

(26)

100 g/l of an oligoethylene glycol diacrylate, 80 g/l of $CH_2{=}CH{-}CO{-}O{-}(CH_2)_2{-}N(CH_3)_3^{+}Cl^-$ and 100 g/l of urea (liquor pick-up about 70%). The fabric is dried and then irradiated on both sides with accelerated electrons in a dosage of 2 Mrad for each side. This gives a brilliant red dyeing having a degree of fixation of 89%.

EXAMPLE 4

A cotton satin fabric is padded with an aqueous solution comprising 30 g/l of a dye of the formula

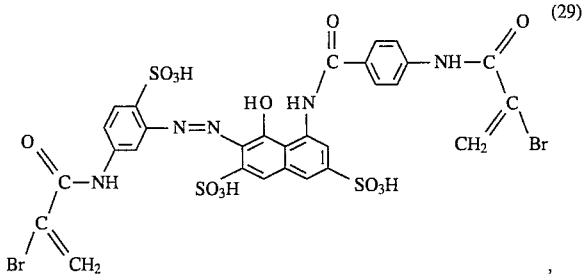

(29)

80 g/l of $CH_2{=}CH{-}CO{-}O{-}CH_2{-}CH_2{-}N(CH_3)_3^+Cl^-$, 100 g/l of an oligoethylene glycol diacrylate and 100 g/l of urea (liquor pick-up about 70% ). The fabric is dried and then irradiated on both sides with a dosage of 2 Mrad for each side. This gives a red dyeing having a degree of fixation of 95%.

EXAMPLE 5

A cotton satin fabric is padded with an aqueous solution comprising 30 g/l of a dye of the formula

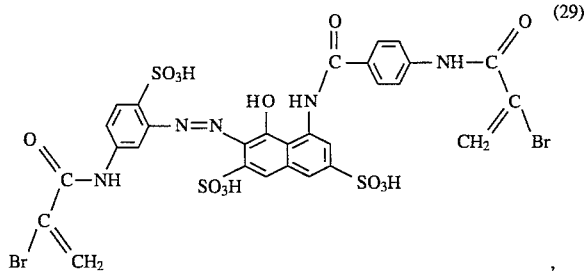

(29)

80 g/l of $CH_2{=}CH{-}O{-}CH_2{-}CH_2{-}N(CH_3)_3^+Cl^-$, 100 gl/ of an oligoethylene glycol diacrylate and 100 g/l of urea (liquor pick-up about 70% ). The fabric is dried and then irradiated on both sides with accelerated electrons in a dosage of only 1 Mrad for each side. This gives a red dyeing having a degree of fixation of 95%.

EXAMPLE 6

A cotton satin fabric is padded with an aqueous solution comprising 30 g/l of a dye of the formula

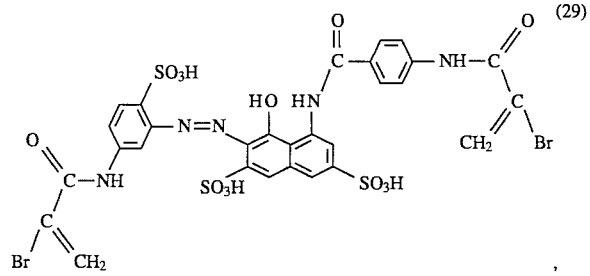

(29)

80 g/l of $CH_2{=}CH{-}CO{-}O{-}CH_2{-}CH_2{-}N(CH_3)^+Cl^-$, 100 g/l of an oligoethylene glycol diacrylate, and 100 g/l of urea (liquor pick-up about 70%). The fabric is dried and then irradiated on only one side with a dosage of 2 Mrad. This gives a red dyeing having a degree of fixation of 94%.

EXAMPLE 7

A cotton satin fabric is padded with an aqueous solution comprising 13.5 g/l of a dye of the formula

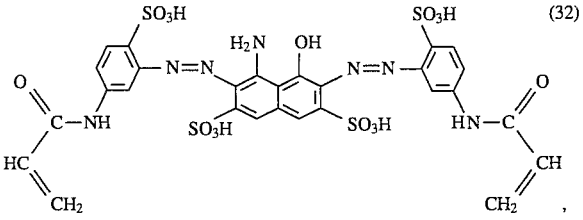

(32)

80 g/l of $CH_2{=}CH{-}O{-}CH_2{-}CH_2{-}N(CH_3)_3^+Cl^-$, 100 g/l of an oligoethylene glycol diacrylate and 100 g/l of urea (liquor pick-up about 70% ). The fabric is dried and then irradiated on both sides with a dosage of only I Mrad per side. This gives a brilliant dyeing having a degree of fixation of 95%.

EXAMPLE 8

A cotton satin fabric is padded with an aqueous solution comprising 20 g/l of a dye of the formula

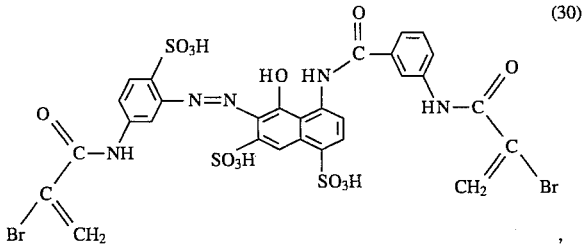

(30)

80 g/l of $CH_2{=}CH{-}O{-}CH_2{-}CH_2{-}N(CH_3)_3^+Cl^-$, 100 g/l of an oligoethylene glycol diacrylate and 100 g/l of urea (liquor pick-up about 70% ). The fabric is dried and then irradiated on both sides with a dosage of only I Mrad per side. This gives a brilliant red dyeing having a degree of fixation of 96%.

EXAMPLE 9

A cotton satin fabric is padded with an aqueous solution comprising 30 g/l of a dye of the formula

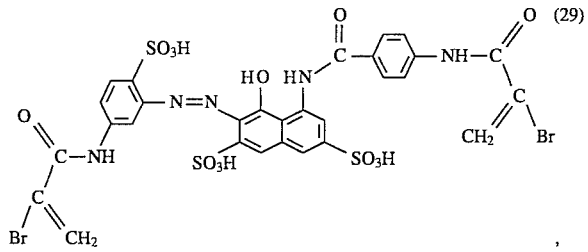

(29)

80 g/l of $CH_2{=}CH{-}CO{-}O{-}CH_2{-}CH_2{-}N(CH_3)_3^+Cl^-$, 100 g/l of an oligoethylene glycol diacrylate, and 100 g/l of the acrylate of 3-(2-hydroxyethyl)-2-oxazolidone (liquor pick-up about 70% ). The fabric is dried and then irradiated on only one side with a dosage of Mrad. This gives a red dyeing having a degree of fixation of 94%.

EXAMPLE 10

A cotton satin fabric is padded with an aqueous solution comprising 30 g/l of a dye of the formula

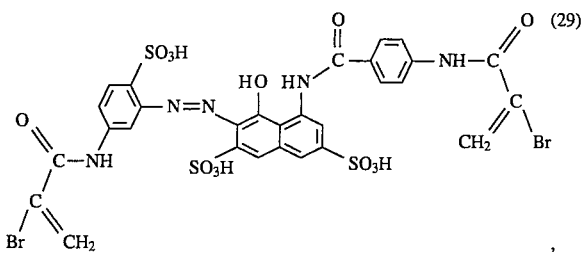

(29)

100 g/l of $CH_2{=}C(CH_3){-}CO{-}O{-}CH_2{-}CHOH{-}CH_2{-}N(CH_3)_3{}^+Cl^-$, 50 g/l of an oligoethylene glycol diacrylate, and 100 g/l of urea (liquor pick-up about 70% ). The fabric is dried and then irradiated on only one side with a dosage of 2 Mrad. This gives a brilliant red dyelag having a degree of fixation of 97%.

EXAMPLE 11

A cotton satin fabric is padded with an aqueous solution comprising 30 g/l of a dye of the formula

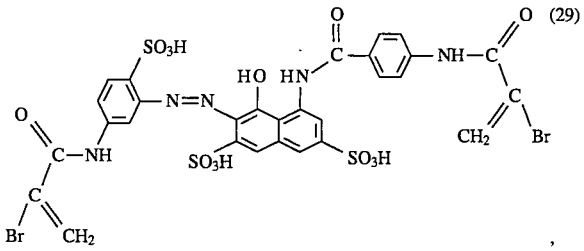

(29)

100 g/l of $CH_2{=}C(CH_3){-}CO{-}O{-}CH_2{-}CHOH{-}CH_2{-}N(CH_3)_3{}^+Cl^-$ and 100 g/l of an oligoethylene glycol diacrylate (liquor pick-up about 70%). The fabric is dried and then irradiated on only one side with a dosage of 2 Mrad. This gives a brilliant red dyeing having excellent fastness properties and a degree of fixation of 95%.

EXAMPLE 12

A cotton satin fabric is padded with an aqueous solution comprising 30 g/l of a dye of the formula

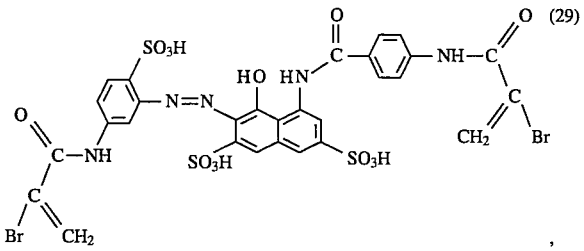

(29)

86 g/l of $CH_2{=}C(CH_3){-}CO{-}O{-}CH_2{-}CH_2{-}N(CH_3)_3{}^+Cl^-$, 100 g/l of an oligoethylene glycol diacrylate, and 100 g/l of urea (liquor pick-up about 70% ). The fabric is dried and then irradiated on only one side with a dosage of 2 Mrad. This gives a brilliant red dyeing having a degree of fixation of 100%.

EXAMPLE 13

A cotton satin fabric is padded with an aqueous solution comprising 30 g/l of a dye of the formula

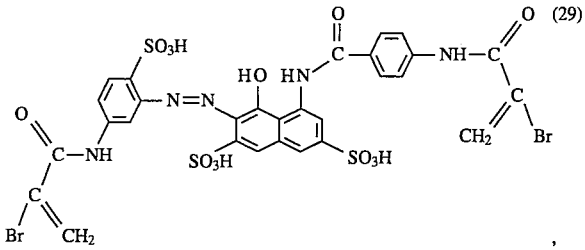

(29)

100 g/l of $CH_2{=}C(CH_3){-}CO{-}O{-}CH_2{-}CH_2{-}N(CH_3)_3{}^+Cl^-$ and 100 g/l of urea (liquor pick-up about 70%). The fabric is dried and then irradiated on only one side with a dosage of 2 Mrad. This gives a brilliant red dyeing having a degree of fixation of 91%.

EXAMPLE 14

A cotton cretonne fabric is padded with a mixture comprising the dyes listed in Table I in the amounts given there, 100 g/l of an oligoethylene glycol diacrylate (average molecular weight of 508 g/mol), 85 g/l of 2-methacryloyioxyethyltrimethylammonium chloride and 100 g/l of urea (liquor pick-up about 70%). The fabric is dried and then irradiated on both sides with accelerated electrons in a dosage of 1 Mrad for each side. This gives brilliant dyeings having the degrees of fixation listed in Table 1.

TABLE 1

| Dye of the formula No. | Amount in g/l | Degree of fixation |
|---|---|---|
| (36) Yellow | 50.6 | 100% |
| (37) Orange | 17.2 | 99% |
| (38) Red | 34.3 | 99% |
| (39) Red | 31.6 | 99% |
| (40) Red | 23.4 | 99% |
| (44a) Blue | 24.1 | 98% |
| (41) Red | 30.0 | 90% |
| (42) Red | 22.4 | 91% |
| (43) Navy | 30.0 | 97% |
| (34) Navy | 20.4 | 99% |

EXAMPLE 15

A cotton cretonne fabric is padded with a mixture comprising the dyes listed in Table 2 in the amounts given there and 85 g/l of $CH_2{=}CCH_3{-}CO{-}O{-}CH_2{-}CH_2{-}N^{\oplus}(CH_3)_3Cl^{\ominus}$ liquor pick-up about 70%). The fabric is then irradiated on both sides with accelerated electrons in a dosage of 1 Mrad for each side. This gives brilliant dyeings having the degrees of fixation listed in Table 2.

TABLE 2

| Dye of the formula No. | Amount in g/l | Degree of fixation |
|---|---|---|
| (29) Red | 30.0 | 97% |
| (30) Red | 23.7 | 96% |
| (31) Black | 26.1 | 99% |

What is claimed is:

1. A process for the dyeing or printing of organic material, which comprises applying a dye containing at least one polymerisable double bond together with at least one colourless cationic compound containing at least one polymerisable double bond and optionally one or more colourless nonionic compounds containing at least one polymerisable double bond and, optionally, further auxiliaries to the organic material, and then fixing the dye by means of ionising radiation.

2. A process according to claim 1, wherein the colourless nonionic compound is a monomeric, oligomeric or polymeric organic compound containing at least one polymerisable double bond or a mixture thereof.

3. A process according to claim 1, wherein the colourless cationic compound is a quaternary ammonium salt carrying at least one polymerisable double bond, or a mixture thereof.

4. A process according to claim 3, wherein the colourless cationic compound is a quaternary ammonium salt of the formula $$(R_1R_2R_{2'}R_{2''}N)_m^+(A)^{m-} \quad (7)$$

in which $R_1$ is a radical of the formula $$CH_2{=}CX{-}Y{-}Q{-} \quad (7a)$$

in which

X is hydrogen, $C_{1-2}$alkyl or halogen,

Y is —CO—O—, —CO—NH— or a direct bond,

Q is $-CH_2-CHOH-CH_2-$, $-(CH_2)_t-$ or $-(CH_2-(CH_2-O)_t-CH_2-CH_2-$,

A is an anion selected from the group consisting of halides, sulfates, alkyl$_{1-2}$sulfates, thiosulfates, phosphates, carboxylates and sulfonates, $R_2$, $R_{2'}$ and $R_{2''}$, independently of one another, are hydrogen $C_{1-24}$alkyl or $R_1$, or the quaternary nitrogen atom in formula (7) is a member of an N-heterocyclic ring, which is substituted or unsubstituted and can contain further hetero atoms, m is 1, 2 or 3 and t is an integer between 1 and 20.

5. A process according to claim 1, wherein the colourless nonionic compound is selected from the group consisting of acrylates, methacrylates, acrylamides and methacrylamides.

6. A process according to claim 4, wherein the colourless cationic compound is a quaternary ammonium salt of the formula $$CH_2{=}CH{-}CO{-}O{-}CH_2{-}CH_2{-}N(CH_3)_3^+A^- \quad (7b)$$

$$CH_2{=}C(CH_3){-}CO{-}O{-}CH_2{-}CH_2{-}N(CH_3)_3^+A^- \quad (7c)$$

$$CH_2{=}C(CH_3){-}CO{-}NH{-}CH_2{-}CH_2{-}N(CH_3)_3^+A^- \quad (7d)$$

$$CH_2{=}C(CH_3){-}CO{-}O{-}CH_2{-}CHOH{-}CH_2{-}N(CH_3)_3^+A^- \quad (7e)$$

or $$(CH_3)_2(CH_2{=}CH{-}CH_2)_2N^+A^- \quad (7f)$$

in which A is an anion selected from the group consisting of halides, sulfates, $C_{1-2}$alkylsulfates, thiosulfates, phosphates, carboxylates and sulfonates.

7. A process according to claim 5, wherein the colourless nonionic compound used is a diacrylate of the formula $$CH_2{=}CR_3{-}CO{-}O{-}(CH_2{-}CH_2{-}O)_n{-}CO{-}CR_3{=}CH_2 \quad (9)$$

in which $R_3$ is hydrogen or $C_{1-2}$alkyl and n is an integer between 1 and 12.

8. A process according to claim 1, wherein a mixture of one or more colourless cationic compounds with one or more colourless nonionic compounds is used.

9. A process according to claim 8, wherein a mixture of one or more quaternary ammonium salts of the formula $$(R_1R_2R_{2'}R_{2''}N)_m^+(A)^{m-}, \quad (7)$$

in which $R_1$ is a radical of the formula $$CH_2{=}CX{-}Y{-}Q{-} \quad (7a)$$

in which

X is hydrogen, $C_{1-2}$alkyl or halogen,

Y is —CO—O—, —CO—NH— or a direct bond,

Q is $-CH_2-CHOH-CH_2-$, $-(CH_2)_t-$ or $-(CH_2-CH_2-O)_t-CH_2-CH_2-$,

A is an anion selected from the group consisting of halides, sulfates, $C_{1-2}$alkyl sulfates, thiosulfates, phosphates, carboxylates and sulfonates, $R_2$, $R_{2'}$ and $R_{2''}$, independently of one another, are hydrogen, $C_{1-24}$alkyl or $R_1$, or the quaternary nitrogen atom in formula (7) is a member of an N heterocyclic ring which is substituted or unsubstituted and can contain further hetero atoms, m is 1, 2 or 3 and t is an integer between 1 and 20, together with one or more colourless nonionic compounds selected from the group consisting of acrylates, methacrylates, acrylamides and methacrylamides is used.

10. A process according to claim 1, wherein the organic material is a fibre material.

11. A process according to claim 1, wherein the dyed or printed organic material is irradiated with ionising radiation while wet.

12. A process according to claim 1, wherein the dyed or printed organic material is irradiated with ionising radiation while dry.

13. Organic material dyed or printed and irradiated with ionising radiation by the process according to claim 1.

14. A process according to claim 1, wherein the dye has the formula $$D{-}(P)_r \quad (1)$$

in which D is the radical of an organic dye selected from the group consisting of monoazo, polyazo, metal complex azo, anthraquinone, phthalocyanine, formazan, azomethine, nitroaryl, dioxazine, phenazine, stilbene, triphenylmethane, xanthene, thioxanthone, naphthoquinone, pyrenequinone and perylenetetracarbimide dyes, P is a radical having a polymerisable double bond and r is the number 1, 2, 3, 4, 5 or 6.

15. A process according to claim 14, wherein the dye has the formula $$D'{-}(P)_r \quad (1a)$$

in which P is a radical having a polymerisable double bond, r is the number 1, 2, 3, 4, 5, or 6 and D' is the radical of an organic dye selected from the group consisting of monoazo or polyazo, formazan, anthraquinone, phthalocyanine and dioxazine dyes.

16. A process according to claim 1, wherein the dye contains at least one acrylamide, methacrylamide, bromoacrylamide, chloroacrylamide or vinylsulfonyl group.

17. A process according to claim 14, wherein the dye has at least one radical having a polymerisable double bond which is selected from the group consisting of acrylamide, methacrylamide, bromoacrylamide, chloroacrylamide and vinylsulfonyl radicals.

18. A process according to claim 9, wherein a mixture of quaternary ammonium salts of the formulae $$CH_2{=}CH{-}CO{-}O{-}CH_2{-}CH_2{-}N(CH_3)_3{}^+A^- \quad (7b)$$

$$CH_2{=}C(CH_3){-}CO{-}O{-}CH_2{-}CH_2{-}N(CH_3)_3{}^+A^- \quad (7c)$$

$$CH_2{=}C(CH_3){-}CO{-}NH{-}CH_2{-}CH_2{-}CH_2{-}N(CH_3)_3)_3{}^+A \quad (7d)$$

$$CH_2{=}C(CH_3){-}CO{-}O{-}CH_2{-}CHOH{-}CH_2{-}N(CH_3)_3{}^+A^- \quad (7e)$$

or $$(CH_3)_2(CH_2{=}CH{-}CH_2)_2N^+A^- \quad (7f)$$

in which A is an anion selected from the group consisting of halides, sulfates, $C_{1-3}$alkyl sulfates, thiosulfates, phosphates, carboxylates and sulfonates, together with acrylates of the formulae $$CH_2{=}CR_3{-}CO{-}O{-}(CH_2{-}CH_2{-}O)_n{-}CO{-}CR_3{=}CH_2 \quad (9)$$

and $$CH_2{=}CR_3{-}Y{-}Q{-}R_{18} \quad (10)$$

in which $R_3$ is hydrogen or $C_{1-2}$alkyl, n is an integer between 1 and 12, Y is —CO—O—, —CO—NH— or a direct bond, Q is —$CH_2$—CHOH—$CH_2$—, —$(CH_2)_t$— or —$(CH_2$—$CH_2$—O)$_t$—$CH_2$—$CH_2$—, $R_3$ is hydrogen or $C_{1-2}$alkyl, $R_{18}$ is 2-oxazolidon-3-yl and t is an integer between 1 and 20 is used.

19. A process according to claim 1, wherein a dye containing at least one bromoacrylamide, chloroacrylamide, acrylamide or vinylsulfonyl group is used together with a quaternary ammonium salt selected from the group consisting of:

$$CH_2{=}CH{-}CO{-}O{-}CH_2{-}CH_2{-}N(CH_3)_3{}^+A^- \quad (7b)$$

$$CH_2{=}C(CH_3){-}CO{-}O{-}CH_2{-}CH_2{-}N(CH_3)_3{}^+A^- \quad (7c)$$

$$CH_2{=}C(CH_3){-}CO{-}NH{-}CH_2{-}CH_2{-}CH_2{-}N(CH_3)_3{}^+A^- \quad (7d)$$

$$CH_2{=}C(CH_3){-}CO{-}O{-}CH_2{-}CHOH{-}CH_2{-}N(CH_3)_3{}^+A^- \quad (7e)$$

and $$(CH_3)_2(CH_2{=}CH{-}CH_2)_2N^+A^- \quad (7f)$$

in which A is halide, sulfate or $C_{1-2}$alkyl sulfate, and a bireactive acrylic compound of the formula $$CH_2{=}CR_3{-}CO{-}O{-}(CH_2{-}CH_2{-}O)_{n'}{-}CO{-}CR_3{=}CH_2 \quad (9a)$$

in which $R_3$ is hydrogen or $C_{1-2}$alkyl and n' is 1 to 9.

20. A process according to claim 1, wherein the ionising radiation used are electron beams generated in a particle accelerator or are β- or γ-rays.

21. A process according to claim 1, wherein a dye containing at least one bromoacrylamide, chloroacrylamide, acrylamide or vinylsulfonyl group is used together with a quaternary ammonium salt selected from the group consisting of:

$$CH_2{=}CH{-}CO{-}O{-}CH_2{-}CH_2{-}N(CH_3)_3{}^+A^- \quad (7b)$$

$$CH_2{=}C(CH_3){-}CO{-}O{-}CH_2{-}CH_2{-}N(CH_3)_3{}^+A^- \quad (7c)$$

$$CH_2{=}C(CH_3){-}CO{-}NH{-}CH_2{-}CH_2{-}C_2{-}N(CH_3)_3{}^+A^- \quad (7d)$$

$$CH_2{=}C(CH_3){-}CO{-}O{-}CH_2{-}CHOH{-}CH_2{-}N(CH_3)_3{}^+A^- \quad (7e)$$

and $$(CH_3)_2(CH_2{=}CH{-}CH_2)_2N^+A^- \quad (7f)$$

in which A is halide, sulfate or $C_{1-2}$alkyl sulfate, a reactive acrylic compound of the formula $$CH_2{=}CR_3{-}Y{-}Q{-}R_{18} \quad (10)$$

in which Y is —CO—O—, —CO—NH— or a direct bond, Q is —$CH_2$—CHOH—$CH_2$—, —$(CH_2)_t$— or —$(CH_2$—$CH_2$—O)$_t$—$CH_2$—$CH_2$—, $R_3$ is hydrogen or $C_{1-2}$alkyl, $R_{18}$ is 2-oxazolidon-3-yl and t is an integer between 1 and 20, and a bireactive compound of the formula $$CH_2{=}CR_3{-}CO{-}O{-}(CH_2{-}CH_2{-}O)_{n'}{-}CO{-}CR_3{=}CH_2 \quad (9a)$$

in which $R_3$ is hydrogen or $C_{1-2}$alkyl and n' is 1 to 9.

22. A process according to claim 1, wherein printing takes place by means of an ink-jet printer.

23. A process according to claim 1, wherein the dye is fixed with a dosage of ionising radiation of 0.1 to 15 Mrad.

24. A process according to claim 1, wherein irradiation with ionising radiation is carried out under a protective gas atmosphere.

25. A process according to claim 1, wherein fixation is carried out continuously.

26. A process according to claim 1, wherein not only dyeing or printing but also fixation of the dyes on the organic material is carried out continuously.

27. A process according to claim 10, wherein the fibre material is wool, silk, hair, alginate fibres, polyvinyl, polyacrylonitrile, polyester, synthetic polyamide, polypropylene, polyurethane, cellulose-containing fibres or glass fibres.

28. A process according to claim 27, wherein dyed or printed cellulose fibres or cellulose-containing fibres and polyester fibres are used.

29. A process according to claim 27, wherein a polyester/cellulose blend fabric is used.

30. A process according to claim 1, wherein a preparation comprising (a) 5–30 parts by weight of a dye containing at least one polymerisable double bond, (b) 5–70 parts by weight of a colourless cationic compound containing at least one polymerisable double bond, and (c) 0–60 parts by weight of a nonionic colourless compound containing at least one polymerisable double bond, relative to 100 parts by weight of the preparation is applied to the organic material.

31. A process according to claim 5, wherein the colourless nonionic compound is an acrylate of the general formula $$CH_2{=}CR_3{-}Y{-}Q{-}R_{18} \quad (10)$$

in which Y is —CO—O—, —CO—NH— or a direct bond,

Q is $-CH_2-CHOH-CH_2-$, $-(CH_2)_t-$ or $-(CH_2-CH_2-O)_t-CH_2-CH_2-$, $R_3$ is hydrogen or $C_{1-2}$alkyl, $R_{18}$ is 2-oxazolidon-3-yl and t is an integer between 1 and 20.

32. A process according to claim 3, wherein the mixture of the colourless organic compounds used contains a combination of quaternary ammonium salts of the formula $$(R_1R_2R_{2'}R_{2''}N)_m^{+}(A)^{m-}, \quad (7)$$

in which $R_1$ is a radical of the formula $$CH_2{=}CX{-}Y{-}Q{-} \quad (7a)$$

in which

X is hydrogen, $C_{1-2}$alkyl or halogen,

Y is —CO—O—, —CO—NH— or a direct bond,

Q is $-CH_2-CHOH-CH_2-$, $-(CH_2)_t-$ or $-(CH_2-CH_2-O)_t-CH_2-CH_2-$,

A is an anion selected from the group consisting of halides, sulfates, $C_{1-24}$alkyl sulfates, thiosulfates, phosphates, carboxylates and sulfonates, $R_2$, $R_{2'}$ and $R_{2''}$, independently of one another, are hydrogen, $C_{1-24}$alkyl or $R_1$, or the quaternary nitrogen atom in formula (7) is a member of an N heterocyclic ring which is substituted or unsubstituted and can contain further hetero atoms, m is 1, 2 or 3 and t is an integer between 1 and 20.

33. A process according to claim 32, wherein the mixture of the quaternary ammonium salts is of the formula $$CH_2{=}CH{-}CO{-}O{-}CH_2{-}CH_2{-}N(CH_3)_3^{+}A^{-} \quad (7b)$$

$$CH_2{=}C(CH_3){-}CO{-}O{-}CH_2{-}CH_2{-}N(CH_3)_3^{+}A^{-} \quad (7c)$$

$$CH_2{=}C(CH_3){-}CO{-}NH{-}CH_2{-}CH_2{-}CH_2{-}N(CH_3)_3^{+}A^{-} \quad (7d)$$

$$CH_2{=}C(CH_3){-}CO{-}O{-}CH_2{-}CHOH{-}CH_2{-}N(CH_3)_3^{+}A^{-} \quad (7e)$$

or $$(CH_3)_2(CH_2{=}CH{-}CH_2)_2N^{+}A^{-} \quad (7f)$$

in which A is an anion selected from the group consisting of halides, sulfates, $C_{1-2}$alkyl sulfates, thiosulfates, phosphates, carboxylates and sulfonates.

34. A process according to claim 9, wherein a mixture of quaternary ammonium salts of the formula $$CH_2{=}CH{-}CO{-}O{-}CH_2{-}CH_2{-}N(CH_3)_3^{+}A^{-} \quad (7b)$$

$$CH_2{=}C(CH_3){-}CO{-}O{-}CH_2{-}CH_2{-}N(CH_3)_3^{+}A^{-} \quad (7c)$$

$$CH_2{=}C(CH_3){-}CO{-}NH{-}CH_2{-}CH_2{-}CH_2{-}N(CH_3)_3^{+}A^{-} \quad (7d)$$

$$CH_2{=}C(CH_3){-}CO{-}O{-}CH_2{-}CHOH{-}CH_2{-}N(CH_3)_3^{+}A^{-} \quad (7e)$$

or $$(CH_3)_2(CH_2{=}CH{-}CH_2)_2N^{+}A^{-} \quad (7f)$$

in which A is an anion selected from the group consisting of halides, sulfates, $C_{1-2}$alkyl sulfates, thiosulfates, phosphates, carboxylates and sulfonates, together with a diacrylate of the formula $$CH_2{=}CR_3{-}CO{-}O{-}(CH_2{-}CH_2{-}O)_n{-}CO{-}CR_3{=}CH_2 \quad (9)$$

in which $R_3$ is hydrogen or $C_{1-2}$alkyl and n is an integer between 1 and 12, is used.

35. A preparation comprising

5–30 parts by weight of a dye of the formula

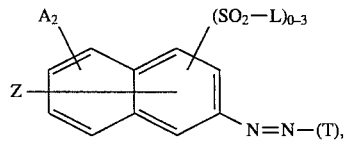

(11)

in which

L is OH or

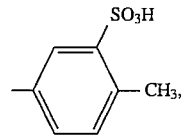

(12)

$A_2$ is hydrogen or $C_1$–$C_3$alkyl,

T is a radical of the formula

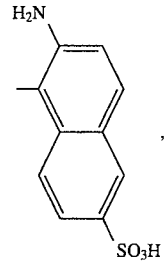

(13)

-continued
(14)
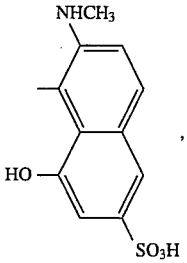
(15)
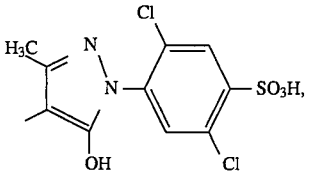
(16)
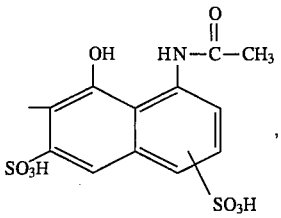
(17)
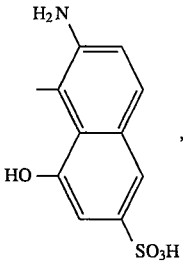
(18)
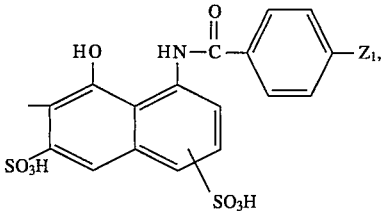
(19)
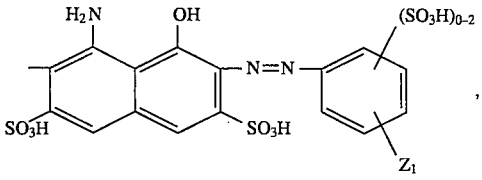
(20)
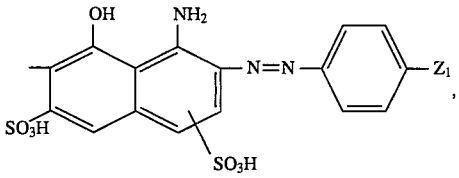
-continued
(21)
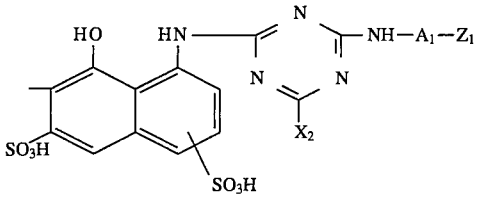
or
(22)
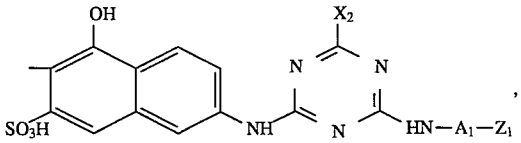
Z and $Z_1$, independently of one another, are hydrogen or radicals of the formulae
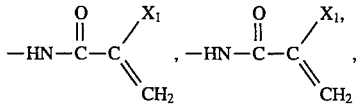
$-SO_2-CH=CH_2$, or
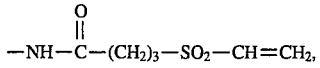
$X_2$ is chlorine or fluorine,
$X_1$ and $X_{1'}$ are independently of one another hydrogen, chlorine, bromine or methyl and
$A_1$ is direct bond, $-C_2H_4-O-C_2H_4-$,
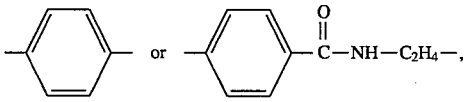
or of a dye of the formula
(44)
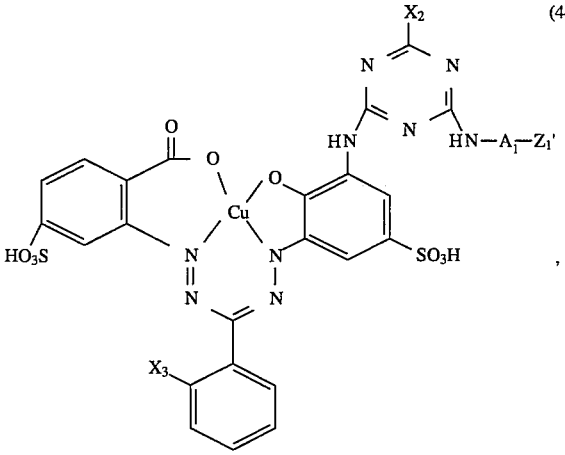
in which
$Z_{1'}$ is a radical of the formula
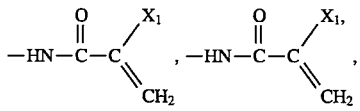
$-SO_2-CH=CH_2$, or -continued $$-NH-\overset{O}{\overset{\|}{C}}-(CH_2)_3-SO_2-CH=CH_2;$$

$X_1$ and $X_{1'}$ are independently of one another hydrogen, chlorine, bromine or methyl, $X_2$ is chlorine or fluorine and $X_3$ is hydrogen or $SO_3H$, $A_1$ is a direct bond, $-C_2H_4-O-C_2H_4-$,

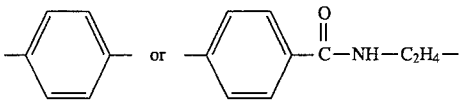

or of a dye of the formula

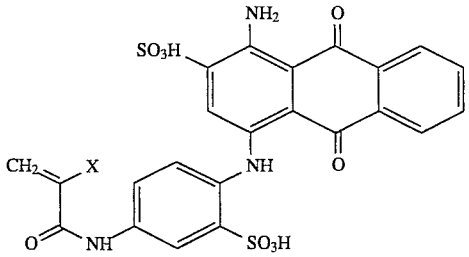

(2a)

in which

X is hydrogen, chlorine, bromine or methyl, 5–70 parts by weight of a quaternary ammonium salt of the formula $$CH_2=CH-CO-O-CH_2-CH_2-N(CH_3)_3^+A^- \quad (7b)$$

$$CH_2=C(CH_3)-CO-O-CH_2-CH_2-N(CH_3)_3^+A^- \quad (7c)$$

$$CH_2=C(CH_3)-CO-NH-CH_2-CH_2-CH_2-N(CH_3)_3^+A^- \quad (7d)$$

$$CH_2=C(CH_3)-CO-O-CH_2-CHOH-CH_2-N(CH_3)_3^+A^- \quad (7e)$$

or $$(CH_3)_2(CH_2=CH-CH_2)_2N^+A^- \quad (7f)$$

in which $A^-$ is chloride or methylsulfate and 0 to 60 parts by weight of an oligoethylene glycol diacrylate, relative to 100 parts by weight of the preparation.

* * * * *